United States Patent [19]

Warde et al.

[11] Patent Number: 4,863,759

[45] Date of Patent: Sep. 5, 1989

[54] CHARGE TRANSFER SIGNAL PROCESSOR AND CHARGE TRANSFER FEEDTHROUGH PLATE FABRICATION ASSEMBLY AND METHOD

[75] Inventors: Cardinal Warde, Newtonville; Robert F. Dillon, Stoneham; Brian A. Hill, Dedham, all of Mass.

[73] Assignee: Optron Systems, Inc., Waltham, Mass.

[21] Appl. No.: 15,054

[22] Filed: Feb. 17, 1987

[51] Int. Cl.[4] ..... B05D 5/12; B05D 7/22; B05D 1/18; B05C 3/02

[52] U.S. Cl. ..... 427/108; 118/410; 118/411; 118/412; 427/123; 427/238; 427/294; 427/333; 427/350; 427/431

[58] Field of Search ..... 427/123, 238, 350, 294, 427/431, 333, 108; 118/410, 411, 421

[56] References Cited

U.S. PATENT DOCUMENTS

| | | | |
|---|---|---|---|
| 3,760,216 | 9/1973 | Lasser et al. | 313/528 |
| 4,220,884 | 9/1980 | Sternbergh | 427/123 |
| 4,732,780 | 3/1988 | Mitoff et al. | 427/123 |

FOREIGN PATENT DOCUMENTS

| | | |
|---|---|---|
| PCT/GB85/-00321 | 3/1985 | PCT Int'l Appl. . |

*Primary Examiner*—Janyce Bell

*Attorney, Agent, or Firm*—Weingarten, Schurgin, Gagnebin & Hayes

[57] ABSTRACT

The disclosed charge transfer signal processor includes a vacuum housing having an input face and an output face, a 2-D electromagnetic input means cooperative with said input face for providing a 2-D input electronic charge signal within the vacuum housing, transfer means for imaging the 2-D input electronic charge signal in a region of the vacuum housing proximate the vacuum housing output face, and charge feedthrough means coupled to the vacuum housing output face for transferring the imaged 2-D electronic charge signal externally to the vacuum housing. In one embodiment, the charge transfer signal processor is operable as Gen-1 charge transfer amplifier. In another embodiment, a microchannel plate assembly is disposed in the vacuum housing intermediate the input and output faces, and the charge transfer signal processor is operable as a high-gain charge transfer signal amplifier. In a futher embodiment, a power microchannel plate assembly is disclosed that is disposed in the vacuum housing intermediate the input and output faces, and the charge transfer signal processor is operable as a high-current charge transfer signal amplifier. The disclosed power microchannel plate assembly preferably includes a 2-D array of axially-aligned discrete dynodes, and a voltage divider network operatively coupled to the 2-D array for providing an electron accelerating potential gradient and for replacing charge as it is depleted by secondary electron emission processes in the several discrete dynodes. The 2-D input electromagnetic signal may either be optical, electronic, or a combination of these two. Various output devices externally mounted to the output face of the vacuum housing are disclosed. Utility includes spatial phase and/or amplitude light modulation, 2-D optical signal processing, and, among others, electromagntic signal detection. A method and an apparatus are disclosed for fabricating the charge feedthrough means.

21 Claims, 23 Drawing Sheets

402

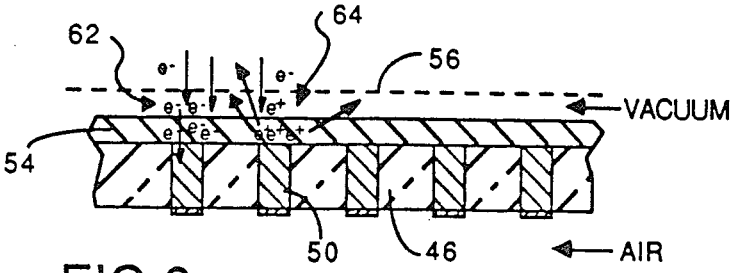
FIG 2
FIG 3A
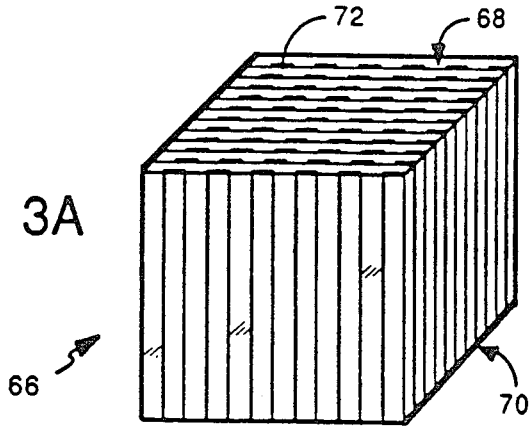
FIG 3B
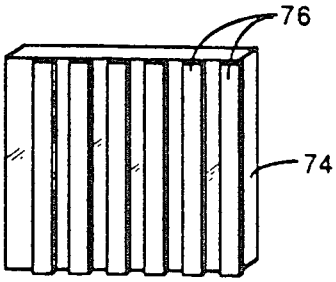

FIG 4A
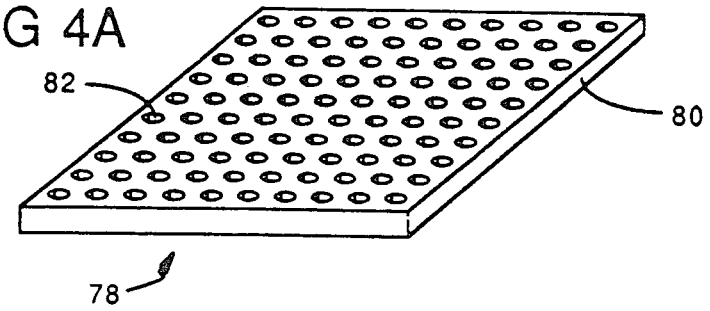
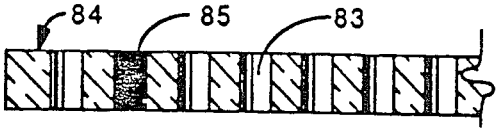
FIG 4B

CHARGE TRANSFER SIGNAL PROCESSOR AND CHARGE TRANSFER FEEDTHROUGH PLATE FABRICATION ASSEMBLY AND METHOD

This invention was made with Government support under Contract F19628-84-C-0048 awarded by the Department of the Air Force. The government has certain rights in the invention.

CROSS REFERENCE TO RELATED APPLICATIONS

This invention is related to commonly assigned copending U.S. patent application Ser. No. 840,684 now U.S. Pat. No. 4,794,296 filed on Mar. 18, 1986.

FIELD OF THE INVENTION

This invention is directed to the field of signal processing, and more particularly, to a novel charge transfer signal processor and to a feedthrough plate assembly production system and method.

BACKGROUND OF THE INVENTION

In many applications, it is desirable to convert the spatially-varying signal intensity of an input 2-D electromagnetic signal into an amplified electrical 2-D output signal having a spatially-varying output intensity distribution corresponding to that of the input electromagnetic signal. The output electrical signal in this way preserves the information content of the input electromagnetic signal, but in such a way that it may be advantageously utilized in a host of applications environments that include, but are not limited to, imaging detectors, optical signal processors, real-time adaptive optical systems, and target recognition, tracking and optical communications systems. Such 2-D conversion devices are often called upon to provide a high degree of spatial resolution, wide spectral band widths, fast cycle times, the capability to accommodate the heat produced by high-power output utilization devices, control of the electron energy distribution, high-current-level output signals, sensitivity to low input-intensity signal levels, and, among other things, to provide the capability to be fabricated at a reasonably low cost. Reference may be had to U.S. Pat. No. 4,481,531 for an exemplary microchannel spatial light modulator, incorporated herein by reference. The utility of the heretofore known devices has been limited in one or more of the foregoing respects.

SUMMARY OF THE INVENTION

In one embodiment, the charge transfer signal processor of the present invention includes an enclosure defining a vacuum chamber having a first generally planar surface defining an input port and a second generally planar surface spaced from and confronting the first surface defining an output port. A generally planar photocathode member is in communication with the first surface and responsive to incident electromagnetic energy received through the input port for providing an electrical signal having a charge distribution that corresponds to the intensity distribution of the incident electromagnetic energy. A 2-D array of electrically-isolated longitudinally-extending conductors having ends that terminate in first and second planes is coupled to the second surface of the enclosure and mounted within the enclosure with the ends thereof terminating in one of the planes in external communication with the second surface of the enclosure and with the other of the planes thereof internally confronting and in spaced relation to the photocathode member. An enhancer coating of an efficient electron/hole generator is provided over the ends of the 2-D array of electrically-isolated elongated conductors confronting the photocathode. An acceleration grid is provided in the vacuum chamber intermediate the photocathode member and the enhancer coating for providing controlled transport of the photocathode electron distribution to the coated 2-D array of electrically-isolated elongated conductors. The intensity of the transported electrons is amplified by the enhancer coating, and the amplified electrons are locally fed through the conductors providing a spatially varying electron intensity distribution at the output port that corresponds to the intensity distribution at the input port. In this embodiment, the charge transfer signal processor is operable as a high-spatial-resolution, high-temporal-resolution, gen-1 type charge transfer amplifier.

In a further embodiment, one or more microchannel plates are operatively connected between the photocathode member and the acceleration grid within the vacuum enclosure of the charge transfer signal processor. The one or more micochannel plates are operative in response to the photocathode electron distribution to locally amplify the electronic charge distribution in such a way that it is everywhere representative of the spatial intensity distribution of the input electromagnetic signal. The electric field provided by the grid proximity focuses the amplified charge distribution onto the enhancer coating of the output conductor array, which, in turn, feeds it externally of the enclosure. In this embodiment, the charge transfer signal processor is operable as a high-gain charge transfer amplifier.

In a further embodiment, the charge transfer signal processor further includes a power microchannel plate operatively connected in the vacuum chamber intermediate the input port and the acceleration grid of the vacuum enclosure. The power microchannel plate includes a laminated stack of perforated insulative sheets alternating with secondary-electron emitting and electrically conductive layers. The several layers cooperate with the several perforated insulative sheets to provide a 2-D array of plural axially-aligned discrete dynodes. A potential gradient is applied across the several layers in such a way that the power microchannel plate is operative as an electron amplifier capable of delivering high output current densities. In this embodiment, the charge transfer signal processor is operable as a high-current charge transfer amplifier.

Different light modulating elements or electronic signal output devices are selectively coupleable to the output port of the charge transfer signal processor and externally of the enclosure. In dependence on the type of output device selected and on the particular embodiment, the novel charge transfer signal processor of the present invention is operative, among others, to provide high-speed, low-light-level, deformable mirrors for adaptive optics applications; ultra-high-speed, low-light-level, high-resolution spatial phase and amplitude modulators for optical computing, target recognition, tracking, and signal processing; and, among others, ultra-fast, low-light-level, high-resolution detectors for astronomy and for optical communications applications.

In each of the several embodiments, the input electromagnetic signal can be optical, electrical, or a combination of the two. The optical input signals may be either coherent or incoherent. The input electrical signal may be a controlled electron-beam input which can be simultaneously and/or successively applied.

Method and apparatus are also disclosed for fabricating high spatial resolution charge transfer feedthrough plates, in such a way that the plural conductors of the high spatial resolution charge transfer feedthrough plate assemblies are individually vacuum-tight with the surrounding insulative body, and are parallel with each other in a regular two-dimensional array, well adapted for high spatial resolution optical signal processing. The phrase "high spatial resolution" designates from about 400 to about 3,600 conductors per square millimeter. The assemblies provided in accordance with the invention are geometrically scalable to provide 2-D arrays from about one square millimeter to the several square inches in size, and are provided thereby at a reasonably low-cost and at a comparatively high production volume.

BRIEF DESCRIPTION OF THE DRAWINGS

These and other features and attendant advantages of the present invention will become apparent as the invention becomes better understood by referring to the following solely exemplary and non-limiting detailed description of the preferred embodiments thereof, and to the drawings, wherein:

FIG. 2 is a schematic diagram useful in illustrating two modes by which information is written in the charge transfer signal processor according to the present invention:

FIG. 3 is a perspective view illustrating in FIGS. 3A and 3B thereof one embodiment of a charge collecting and feed-through plate assembly of the charge transfer signal processor according to the present invention;

FIG. 4 illustrates in FIG. 4A a perspective view and in FIG. 4B a partial sectional view illustrating a second embodiment of the charge collecting and feed-through plate assembly of the charge transfer signal processor according to the present invention;

DETAILED DESCRIPTION OF THE PREFERRED EMBODIMENTS

Figure 1A:
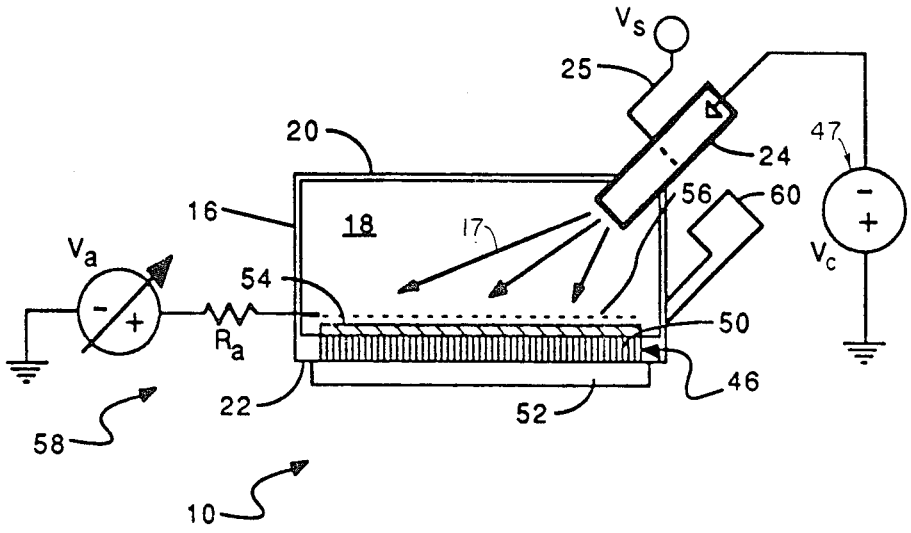
FIG. 1 illustrates 1A–1C thereof diagrammatic views of a first embodiment of the charge transfer signal processor according to the present invention respectively showing three different input electromagnetic structures.
Figure 1B:
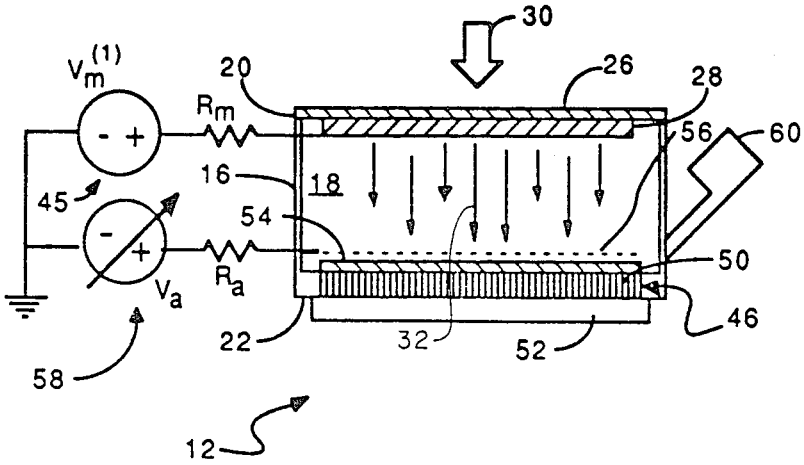
Figure 1C:
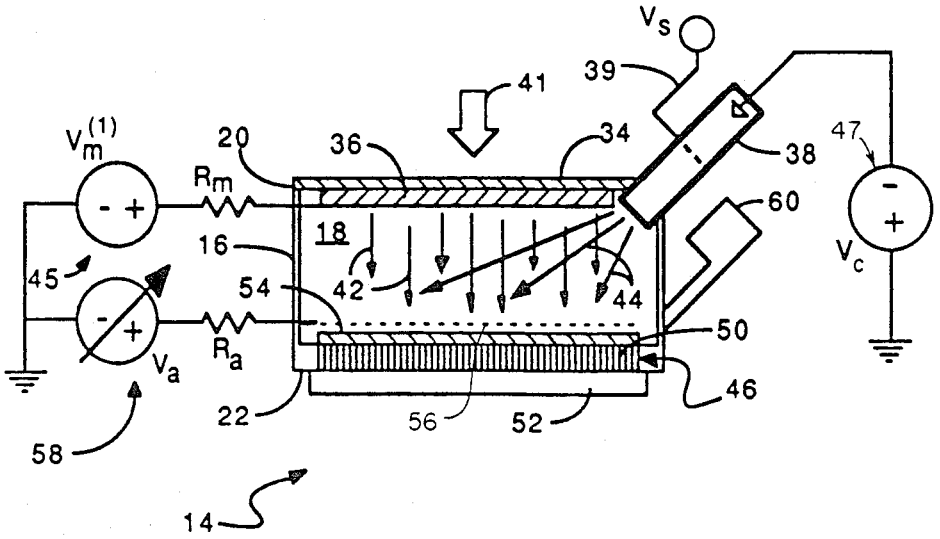

Referring now to FIG. 1, respectively generally designated at 10, 12, and 14 in FIGS. 1A, 1B, and 1C are three embodiments of a gen-1 type charge transfer signal processor according to the present invention. The charge transfer devices 10, 12, 14 are substantially identical and principally differ in the structure of the input electromagnetic excitation signal source. The charge transfer devices 10, 12, 14 each include a housing 16 defining an enclosed vacuum generally designated 18. The housings 16 each include top input and bottom output faces 20, 22 of a generally-cylindrical shape that respectively define 2-D input and output ports.

A source of electrons, such as from an electron gun 24 vacuum-mounted through the face 20, is provided for writing an input 2-D electromagnetic signal into the charge transfer signal processor 10 of FIG. 1A. An electron control signal 25 marked "$V_s$" is controllably applied to the gun 24. An optically-transmissive window 26 having a deposited layer of a photoemissive material 28 defining a photocathode is vacuum-mounted to the face 20 of the charge transfer signal processor 12 of FIG. 1B. The photocathode 28 cooperates with incident 2-D write light schematically illustrated by an arrow 30 for providing an input 2-D electrical charge distribution, schematically illustrated by variable-length arrows 32, that everywhere locally corresponds to the 2-D intensity distribution of the input write light 30. An optically transmissive window 34 having a deposited layer 36 of any suitable photoemissive material defining a photocathode, and a source 38 of write electrons, such as from an electron gun 38, are vacuum-mounted to the top input face 20 of the charge transfer signal processor 14 in FIG. 1C. An electron control signal 39 marked "$V_s$" is controllably applied to the gun 38. The photocathode 36 is cooperative with write light schematically illustrated by an arrow 41 to provide a spatially-varying 2-D electron distribution that everywhere locally corresponds to the intensity distribution of the write light 41, as schematically illustrated by variable length arrows 42, and the electron source 38 is operative to provide a 2-D electron pattern illustrated by arrows 44. The write light, which may be either coherent or incoherent, and the write electrons, can be either sequentially or simultaneously applied. A biasing network generally designated 45 and marked "$V_m^{(1)}$" is operatively coupled to the photocathodes 28, 36 in FIGS. 1B, 1C, and a biasing network generally designated 47 and marked "$V_c$" is operatively coupled to the cathodes of the guns 24, 38 in FIGS. 1A, 1C. Conventional magnetic, electrostatic, or electromagnetic techniques are employed in the electron guns 24, 38 for electron beam focus and deflection.

A charge transfer feedthrough plate subassembly generally designated 46, to be described, is vacuum-mounted within the bottom output face 22 of the housings 16 of the charge transfer signal processors 10, 12, and 14. The charge transfer feedthrough plate subassemblies 46 each include plural electrically-isolated elongated conductors 50 therethrough the ends of which respectively terminate in a first planar surface internally of the housings 16 and a second planar surface externally of the housings 16. The conductors 50 of the charge transfer feedthrough plate subassembly have a very high spatial density, and are operative to controllably transfer a 2-D electronic charge pattern to the exterior of the housing 16 with a very high spatial resolution. An output device 52 to be described is externally mountable to the output port of the housings 16 and operatively connected electrically to the elongated conductors 50 of the corresponding charge transfer feedthrough plate subassembly 46. The external mounting of the output device 52 makes possible the selection of a wide variety of devices to be described. For example, the output devices then need not be vacuum compatible. Further, they can be externally cooled for high-power applications, and can be readily removably replaced without requiring substantial system disconnection.

A layer of a charge enhancing material 54 is deposited over the inner plane at which the conductors 50 of the charge transfer feedthrough plate subassembly 46 terminate. The layer 54 may be, for example, either a coating of a high secondary electron emitter substance such as MgO or Cu:BeO or an efficient electron/hole generating substance such as silicon or germanium. In the case of the high secondary electron emitter substances the gain provided by the enhancing layer 54 provides for high-sensitivity to the level of the input signal, a high temporal and width, and for control of the write modes to be described of the charge transfer signal processor.

In the case of the electron/hole generating substances, the gain provided by the enhancing layer 54 provides for high-sensitivity to the level of the input signal and provides for a high temporal bandwidth.

A grid 56, maintained at a positive potential by a variable voltage source generally designated 58 and marked "$V_a$", is positioned in the vacuum chamber 18 predominately having only longitudinal electric field components. This field accelerates the 2-D input charge distribution by Coulombic attraction, and images it on the enhancer coating 54 by proximity focusing. Erasure may be provided by flooding the coating 54 from either of the sources of the input electromagnetic signal. An optional electron gun 60 is vacuum-mounted to the housings 16 in position to conveniently flood the coatings 54 for image erasure purposes. It will be appreciated that although electrostatic proximity focusing is disclosed in the preferred embodiments, other suitable charge imaging techniques, such as magnetic, electric, or a combination of the electric and the magnetic, can as well be employed without departing from the inventive concept.

The voltage selected for the grid 56 controls the acceleration of the electrons through the vacuum chamber 18 and therewith controls the kinetic energy of the charges incident on the enhancer coating 54. Where high secondary electron emitting coatings are used, as will be appreciated by those skilled in the art, the gain, DELTA, of the particular material selected for the enhancer coating 54 is a function of the kinetic energy of the incident electron stream. The gain can then be selected to be either greater than or less than unity by varying the grid voltage accordingly. For comparatively-low voltages and corresponding kinetic energies, the gain is selectable to be less-than-unity. In this case, more electrons that are incident on the enhancer coating accumulate thereon as generally designated at 62 in FIG. 2. For comparatively-high grid voltages and corresponding kinetic energies, the gain is selectable to be greater-than-unity. In this case, more electrons are emitted off of the coating than are accumulated thereon, due to the selected high gain coefficient, so that electrons are locally depleted about the surface of the enhancer coating in accordance with the incident intensity of the 2-D electronic charge distribution as generally designated at 64 in FIG. 2. If a comparatively-high resistance enhancer coating 54 is selected, the incident electronic charge integrates during image writing thereonto, and if a comparatively low-resistance enhancer coating 54 is selected, the electronic charges bleed off the enhancer coating at a specific rate. The charge transfer signal processor of the present invention is then in this manner selectably operable in either of a framed or a continuous mode.

In the framed mode images may be written either by electron depletion or by electron accumulation. If the potential of the source 58 is selected such that the incident electronic charges have a kinetic energy that corresponds to operation in the greater-than-unity gain regime, more electrons are given off the enhancer coating by secondary emission than are received so that the image is written in an electron depletion write mode. At the termination of the write period, the accumulated image is erased by flooding the enhancer coating 54 with electrons as from the gun 60. If the potential of the source 58 is selected so that the kinetic energy of the incident electronic charges corresponds to operation in the less-than-unity gain regime, the number of the incident electrons is greater than the electrons knocked thereout by secondary emission such that the image is written by electron accumulation. At the end of the write period, the image is erasable as by controlled emission from the flood gun 60, by flooding the photocathode with light, or by defocusing the signal electron gun 24, 38 as appropriate.

Where efficient electron/hole generators are used for the enhancer coatings, the voltage selected for the grid controls the acceleration of the electrons, and correspondingly their kinetic energy at incidence on the enhancer coating 54. An intended gain, as will be appreciated by those skilled in the art, is provided by selecting the magnitude of the incident kinetic energy of the electron stream, whereby corresponding quantities of electron/hole pairs are generated within the semiconductor material of the enhancer coatings in dependence on the kinetic energy selected. Where necessary, and in accord with the particular output device utilized, the electron erasure gun then floods the enhancer coatings with a uniform electron flux for image erasure purposes.

Referring now to FIG. 3, generally designated at 66 in FIG. 3A is a perspective view of one embodiment of the charge transfer feedthrough plate subassembly of the charge transfer signal processor according to the present invention. The assembly 66 includes an upper, optically-flat generally-planar surface generally designated 68, a lower, optically-flat generally-planar surface generally designated 70, and a 2-D array of electrically-isolated elongated conductors 72 longitudinally extending from the surface 68 to the surface 70. The assembly 66 is preferably fabricated as a fritted, vacuum-tight lamination of plural glass substrates 74 having plural, generally parallel conductive metallic traces 76 on one of the surfaces thereof as best seen in FIG. 3B. Typically, the charge transfer feedthrough plate subassembly 66 is provided with approximately 250,000 to thirty-six million conductors disposed in a 25 millimeter to 150 millimeter square area. The substrates 74 may be 50 micrometer thick glass plates, and the conductors 76 may have exemplary dimensions of about a 5 micrometer thickness, 30 micrometer widths, and a 50 micrometer innerspacing. The charge transfer feedthrough plate subassembly 66 is preferably fabricated by evaporating a metal onto the glass plates 74, and the electrodes 76 are formed thereon preferably by well-known photolithographic techniques. The sheets are cut into the intended dimensions, are stacked, and then are fritted in an evacuated oven to form a preform. The preform is then shaped in an optical lathe into a cylindrical body, transversely cut into the intended widths, and the opposed ends of the resulting charge transfer feedthrough plate subassemblies are polished optically flat.

Referring now to FIG. 4A, generally designated at 78 is a perspective view illustrating another embodiment of the charge transfer feedthrough plate subassembly of the charge transfer signal processor according to the present invention.

The assembly 78 includes an insulative substrate 80, and a plurality of electrically-isolated, vacuum-tight elongated conductors 82 defining a 2-D array longitudinally extending from the top to the bottom of the substrate 80. As can best be seen in FIG. 4B, the substrate 80 preferably includes a glass capillary array 83 having a plurality of apertures generally designated 84 provided therethrough in a regular 2-D pattern. In a presently preferred fabrication sequence, Indium or other 0 suitable conductive material schematically illustrated in solid outline 85 is provided in all of the apertures 84, the stuffed-array is shaped into a cylindrical body in an optical lathe, and then the upper and lower surfaces of the feedthrough plate subassembly 78 are polished optically flat.

In the operation of the charge transfer signal processor of FIG. 1, the photocathode, the electron gun, or a combination of the two, are operative to controllably write a 2-D electronic input signal into the vacuum chamber of the corresponding vacuum housing. The grid images the electron flux 17, 32, 42, 44 onto the enhancer coating, in such a way that the resulting amplified surface charge distribution onto the enhancer coating spatially varies as the intensity of the incident electron flux spatially varies. The feedthrough plate assembly transfers this charge distribution exteriorly of the housing and electrically couples it to the associated output device. The output device can be either electrical, optical, or electro-optical, among others, to be described. For exemplary operation in the framed mode, the electron erase gun periodically floods the enhancer coating for image erasure, and the above process is repeated cyclically.

Figure 5A:
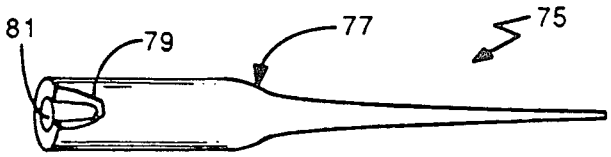
FIG. 5 illustrates in FIGS. 5A a perspective view and in FIG. 5B a partial sectional view illustrating a third embodiment of the charge collecting and feed-through plate assembly of the charge transfer signal processor according to the present invention.
Figure 5B:
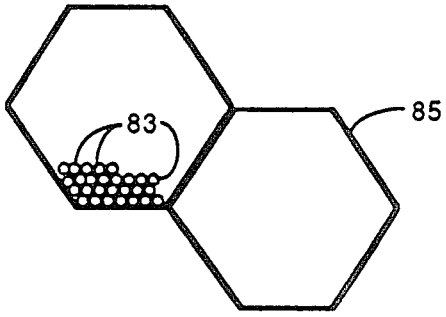

Referring now to FIG. 5A, generally designated at 75 is a pictorial perspective view illustrating a further embodiment of the charge transfer feedthrough plate subassembly of the charge transfer signal processor according to the present invention. A drawable preform generally designated 77 includes an outer insulative sheath 79 such as glass and an inner co-axial conductive core 81 such as either a high-conductivity glass or a low-melting-point metal such as indium, lead or tin. The preform is drawn into a filament by well-known techniques, as is schematically illustrated in FIG. 5A by the elongated tapering tail portion, and after being cut into intermediate lengths plural filaments 83 are stacked into hexagonal or other close-packing templates 85 as shown in FIG. 5B. The several filaments 83 in the hexagonal templates are fused to provide a 2-D array of electrically-isolated longitudinally extending and vacuum-tight conductors, the assembly then is transversely cut into intended longitudinal widths, and the upper and lower surfaces of the resulting feedthrough plate subassemblies are polished optically flat.

Figure 6A:
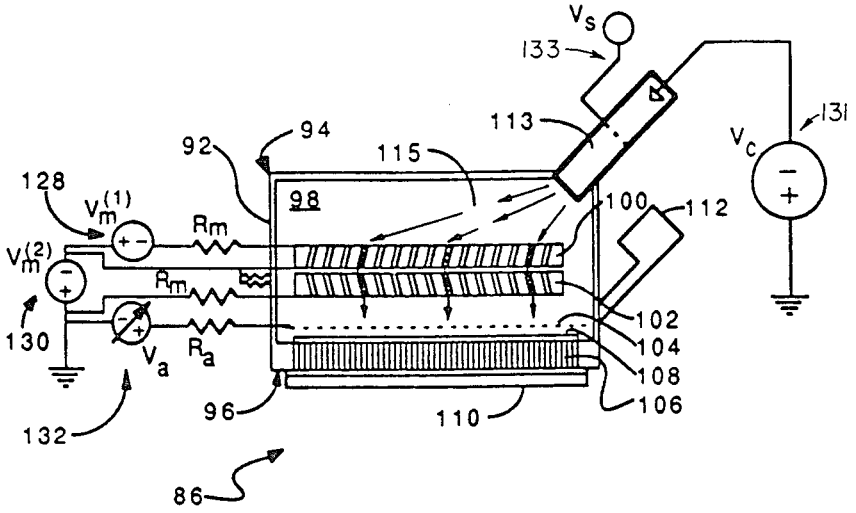
FIG. 6 illustrates FIGS. 6A through 6C thereof diagrammatic views of a second embodiment of the charge transfer signal processor according to the present invention respectively showing three different input electromagnetic structures.
Figure 6B:
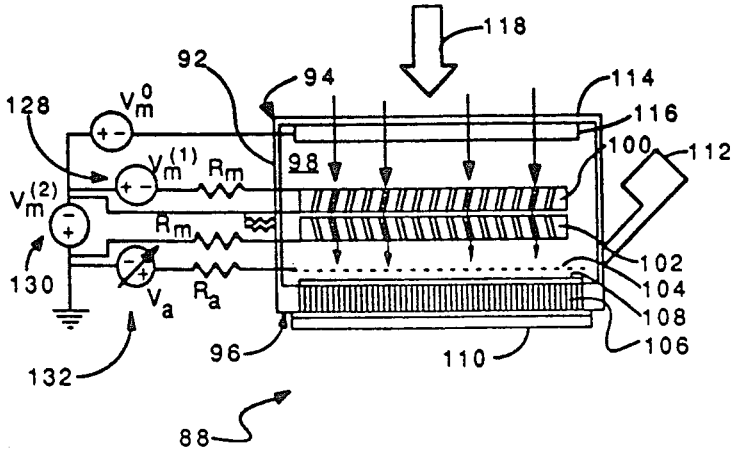
Figure 6C:
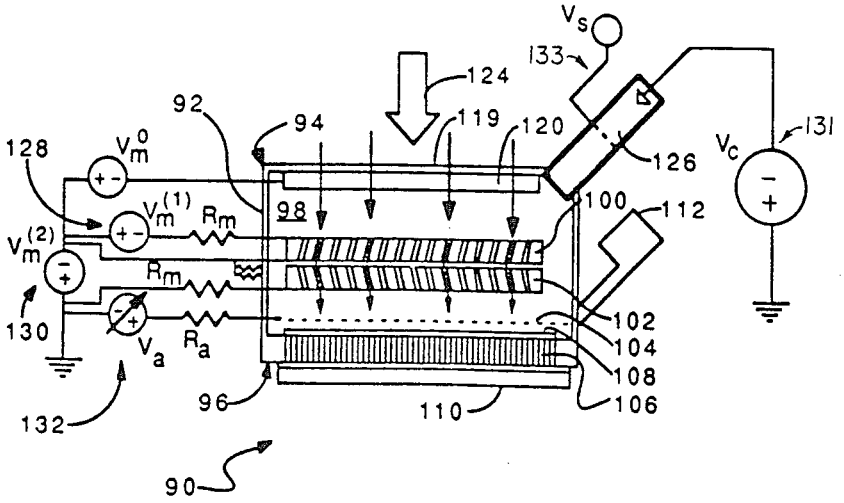

Referring now to FIG. 6, generally designated at 86 in FIG. 6A, at 88 in FIG. 6B, and at 90 in FIG. 6C are three different embodiments of a high-current charge transfer signal processor according to the present invention. Each of the charge transfer signal processors, 86, 88, and 90 includes a housing 92 having an upper, generally-circular input face generally designated 94 and a spaced-apart generally-circular bottom output face generally designated 96 defining therebetween a vacuum chamber generally designated 98. A conventional microchannel plate 100 to be described, a subjacent power microchannel plate 102 to be described, and a subjacent acceleration and control grid 104 are provided in the vacuum chamber 98 and intermediate the top and bottom faces 94, 96 of the several high-current charge transfer signal processors 86, 88, and 90. A charge transfer feedthrough plate subassembly 106 having an enhancer coating 108 on its inside 2-D planar face is vacuum-mounted through the bottom face 96 of the several charge signal processors 86, 88, and 90. An output device 110 is mounted externally to the bottom face 96 in the several embodiments. An optional electron gun 112 is vacuum-mounted to the housings 92 for providing an alternate image erasure control.

The high-current charge transfer signal processors 86, 88, and 90 principally differ in the structure of the input write electromagnetic signal excitation source. An electron gun 113 is vacuum-mounted through the top face 94 of the housing 92 of the high-current charge-transfer amplifier 86 in FIG. 6A for providing an input two-dimensional (2-D) electronic signal write source. An optically transmissive window 114 having a deposited photoemissive layer 116 defining a photocathode is vacuum-mounted to the face 94 of the high-current charge transfer signal processor 88 in FIG. 6B. Input write light illustrated by an arrow 118 is transmitted through the window 114, impinges on the photoemissive material 116 and provides a two-dimensional electronic charge distribution that spatially varies with the 2-D spatial intensity distribution of the input write light 118. In FIG. 6C, an optically transmissive window 119 having a deposited photoemissive layer 120 defining a photocathode is vacuum-mounted to the face 94 of the housing 92 of the high-current charge transfer signal processor 90. The photocathode converts the intensity distribution of input write light schematically illustrated by an arrow 124 into a corresponding 2-D electronic charge distribution. An electron write gun 126 is vacuum-mounted to the housing 92 in FIG. 6C. In each of the embodiments of the high-current charge transfer signal processor 86, 88, and 90 of the present invention, biasing and control networks generally designated 128, 130, and 132 are respectively provided for the microchannel plate 100, the power microchannel plate 102, and for the acceleration and control grid 104. A biasing network generally designated 131 and marked "$V_c$" is coupled to the cathodes of the guns 113, 126 and an electron gun input control signal 133 marked "$V_s$" is coupled to the grids of the guns 113, 126 as shown respectively in FIGS. 6A and 6C. Conventional magnetic, electrostatic or electromagnetic techniques are employed in the electron guns 113, 126 for electron beam focus and deflection.

Figure 7:
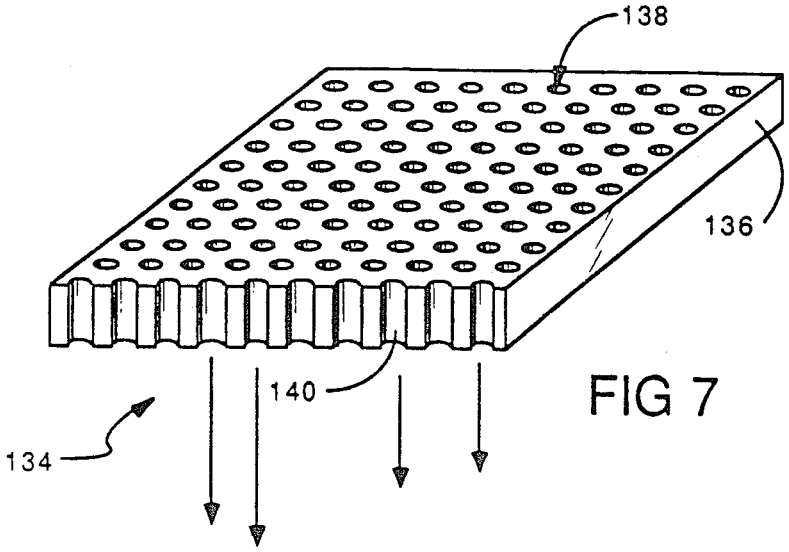
FIG. 7 is a perspective view illustrating a microchannel plate of the charge transfer signal processor according to the present invention.

Referring now to FIG. 7, generally designated at 134 is a fragmentary perspective view illustrating a conventional microchannel plate. The microchannel plate 134 includes a glass substrate 136 having an array of closely-spaced continuous dynodes generally designated 138 provided therethrough. Each dynode 138 includes a coating of a high secondary electron emitting substance 140 disposed about its inside wall that is operative in response to each electron incident into the dynode to provide a multiple electron output from the continuous dynode by a well-known avalanching process. Although an exemplary gain for such microchannel plates may be on the order of ten thousand, the utility of these devices is limited by output-charge-saturation which often restricts the current available from, and the temporal bandwidth of, the conventional microchannel plate subassemblies. A further impediment in the utilization of these devices in some applications is the fact that power is consumed even when electrons are not being extracted therefrom so that is often the case that an intolerably large quantity of heat is generated.

Figure 8A:
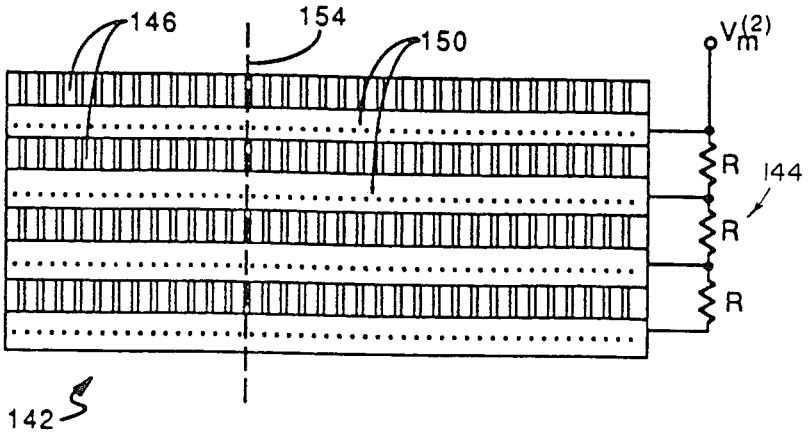
FIG. 8 illustrates in FIG. 8A a side view of and illustrates in FIG. 8B a fragmentary perspective diagram of one embodiment of a power microchannel plate of the charge transfer signal processor according to the present invention.

Referring now to FIG. 8A, generally designated at 142 is a schematic diagram illustrating one embodiment of a power microchannel plate subassembly of the high-current charge transfer signal processor according to the present invention. The power microchannel plate subassembly 142 includes a 2-D array of axially-aligned and spaced-apart plural discrete dynodes. As used herein, the words "discrete dynode" mean that the dynodes of an amplification channel to be described are electrically isolated one from the other. A voltage network generally designated 144 and marked "$V_m^{(2)}$, R" is provided for establishing a potential gradient across constitutive axially-aligned discrete dynodes in the 2-D array. The potential gradient provides longitudinal fields through the axially-aligned discrete dynodes of the array that act to accelerate electron transport therethrough and to replace charge as it is depleted by the high-gain secondary electron emission processes therein, so that axially-aligned discrete dynodes of the 2-D array act as high-current electron amplification channels.

Figure 8B:
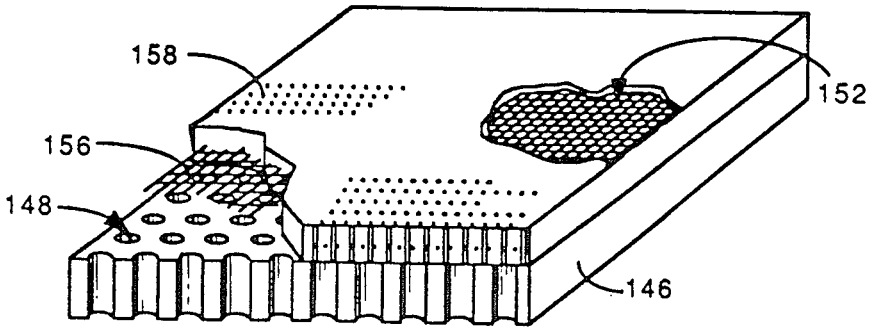

The power microchannel plate subassembly 142 includes a vertical stack of insulative layers 146 having a 2-D aperture pattern therethrough generally designated 148 in FIG. 8B alternating with layers 150 of a high secondary electron emission coefficient conductive material. The layers 150 respectively define 2-D arrays of conductive windows generally designated 152 in FIG. 8B that are cooperative with the apertures of the several layers 146 to provide a 2-D array of high-current electron amplification channels as schematically illustrated by vertical dashed line 154. The longitudinal alignment of the apertures of the several insulative layers defines plural, cross-talk free channels, which channels thus provide a high-spatial-resolution and thereby preserve the fidelity of the input electromagnetic image. The insulative apertured layers 146 preferably include a glass capillary array, that may have, by way of example, a 250 micron thickness, an aperture size of between 10 micrometers and 50 micrometers, approximately a 10 micrometer spacings between the edges of adjacent apertures and from 62,500 to 1,000,000 and more apertures in about a 400 $mm^2$ area. Each of the high secondary electron emission coefficient conductive layers 150 preferably includes a grid of electroformed copper mesh 156 (FIG. 8B) that is coated with a suitable high secondary electron emission coefficient conductive material 158 such as magnesium oxide (MgO). Alternatively, the grid may be fabricated of a high secondary electron emitting conductive material such as Cu:Be. The grid mesh may have an exemplary 5 micrometer thickness with interstitices defining exemplary window sizes of 5 micrometers to 8 micrometers center-to-center spacings. To maximize the yield of secondary electron emission, it is important that the center-to-center spacing of the grid interstices be smaller than the center-to-center spacing of the apertures of the insulative layers 146. The layers 146, 150 are vertically arrayed by any suitable lamination means including, among others, clamping and/or fritting.

Figure 9A:
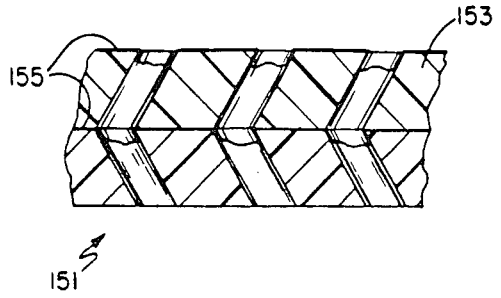
FIG. 9 illustrates in FIG. 9A a side view of and illustrates in FIG. 9B a fragmentary perspective diagram of a further embodiment of the power microchannel plate of the charge transfer signal processor according to the present invention.
Figure 9B:
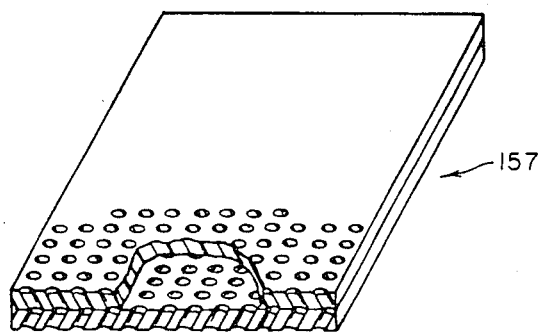

Referring now to FIG. 9A, generally designated at 151 is a sectional view illustrating a further embodiment of a power microchannel plate subassembly of the charge transfer signal processor according to the present invention. The subassembly 151 includes plural, vertically arrayed layers of insulative apertured sheets 153 such as glass capillary arrays. A layer 155 of a high secondary electron emitting conductive material is deposited on the surfaces of each of the apertured sheets 153 so that it extends partway into the aperture. The layers 155 may either be composite or simple. In the former case, a conductive substrate such as silver or aluminum is deposited on the surfaces of the sheets 153, and an overcoating of a high secondary electron emitting material such as MgO is deposited over the substrate layer. In the latter, a single layer of a high secondary electron emitting conductive material such as Cu:Be is deposited on the several layers 153. The sheets 153 are laminated by any suitable means to provide a power microchannel plate subassembly generally designated 157 (FIG. 9B). Incident electrons are multiplied by high-secondary electron emission processes, and are accelerated through the apertures of the several layers by the potential gradient applied thereacross, as in the embodiment of FIG. 8. As charge is depleted, feed charge from the voltage divider network replaces the depleted charge at the rate that the charge is being depleted. The power microchannel plate subassembly 151 therewith provides high-current, non-saturation-limited and cross-talk free amplification through the several constitutive channels thereof.

In the operation of the embodiment of FIG. 6, the input electromagnetic signal 115 in FIG. 6A, 118 in FIG. 6B, and 124, 126 in FIG. 6C is amplified by the respective microchannel plate subassembly 100. Each of the continuous dynodes 138 thereof (FIG. 7) is operative in response to individual incident electrons to provide a large number multiple of the input charge, so that the microchannel plate 100 produces a highly-amplified two-dimensional charge pattern that corresponds to the spatial intensity distribution of the input electromagnetic signal. Each of the axially-aligned discrete dynodes of the power microchannel plate subassembly 102 is operative in response to the output of the confronting dynodes of the microchannel plate subassembly to accelerate the corresponding charge therethrough and to efficiently replace charge as it is depleted therefrom by secondary emission, thereby providing very large output currents without generating heat.

The preselected potential gradient provided by the network "$V_m^{(2)}$" of the power microchannel plate subassembly determines the acceleration of the electrons through the discrete dynode chains thereof and therewith determines their kinetic energy. The potential gradient is preferably selected so as to provide the maximum gain factor of the secondary electron emissive processes in the several constitutive power amplification channels in the several embodiments. The network "$V_v^{(2)}$" feeds charge into the conductive layers thereof at the rate at which charge is depleted in the several axially-aligned discrete dynodes by secondary emission. The feed charge migrates to the several axially-aligned discrete dynodes of the several layers and replaces the depleted charge so that each of the axially-aligned discrete dynode chains of the 2-D array acts as a high-current and non-saturation limited power amplification channel.

The output 2-D high-current signal of the power microchannel plate subassemblies 102 is proximity focused onto the enhancer coatings 108 by the longitudinal fields established by the grids 104, and the charge transfer feedthrough plate assemblies 106 transfer this high-current 2-D electronic charge distribution exteriorly of the housings 92 where it may then be advantageously utilized by any one of a plurality of output devices 110 to be described. As in the embodiment of FIG. 1, the potential applied to the grid 104 is variable to select the gain factor of the enhancer coating 108 which determines operation in either an electron accumulation or an electron depletion write mode.

For an exemplary gain of one thousand from the power microchannel plate subassembly and an exemplary gain of ten thousand from the microchannel plate subassembly, the high-current charge transfer signal processors of the embodiments of FIG. 6 are operable at an exemplary framing rate of 1 kilohertz and with exemplary input irradiance levels in the $10^{-11}$ watts per square centimeter range. If different performance is required, it will be appreciated that an appropriate number of microchannel plate subassemblies and/or power microchannel plate subassemblies, not shown, can with advantage be vertically arrayed in the vacuum chamber 98.

Figure 10:
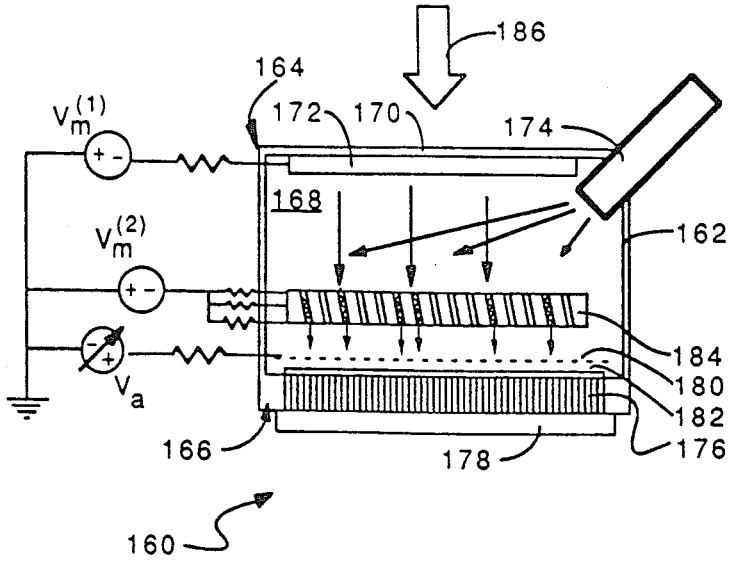
FIG. 10 illustrates a diagrammatic view of a third embodiment of the charge transfer signal processor according to the present invention.

Referring now to FIG. 10, generally designated at 160 is another embodiment of the charge transfer signal processor according to the present invention. The charge transfer signal processor 160 includes a housing 162 having a top input face generally designated 164 and a bottom output face generally designated 166 defining an enclosed vacuum generally designated 168. An optically-transmissive window 170 having a layer of a photoemissive material 172 is vacuum-mounted to the top input face 164. An electron gun 174 is vacuum-mounted to the top input face 164 of the housing 162. A charge transfer feedthrough plate subassembly 176 of the type described above in connection with the description of any one of FIGS. 3, 4, and 5 is vacuum-mounted to the bottom output face 166 of the housing 162. An output device 178 to be described is externally mounted to the exposed face of the charge transfer feedthrough plate subassembly 176. An acceleration grid 180 is provided in the vacuum 168 confronting the charge transfer feedthrough plate assembly 176, and an enhancer coating 182 of the type described above in connection with the description of the embodiments of FIGS. 1 and 6 is disposed on the inside vacuum face of the subassembly 176. A power microchannel plate subassembly 184 of the type described above in connection with the description of either FIG. 8 or FIG. 9 is provided in the vacuum chamber 168 and intermediate the grid 180 and the input face 164. The embodiment of FIG. 10 specifically illustrates a combination electron beam input 174 and a photocathode 172 responsive to input electromagnetic light energy schematically illustrated by an arrow 186 as the input electromagnetic source, although either can be used singly as 2-D input signals, not shown, without departing from the inventive concept.

In the operation of the embodiment of FIG. 10, the input electromagnetic signal is highly current amplified by the power microchannel plate subassembly 184 in the manner described above in connection with the description of FIGS. 8 and 9. The 2-D charge density at the output surface thereof then spatially varies in the same way that the intensity distribution of the input electromagnetic signal varies. This charge distribution is proximity focused onto the enhancer coating 182 by the acceleration and control grid 180, and the charge transfer feedthrough plate subassembly 176 then moves this charge distribution exteriorly of the housing 162 for utilization by an suitable output device 178 to be described. It will be appreciated that other imaging techniques can be employed as well, and that the charge transfer signal processor of FIG. 10 is operable in either an electron accumulation or electron depletion write mode by appropriate selection of the applied grid potential when the enhancer coating 182 is of the efficient secondary electron emission type.

Figure 11A:
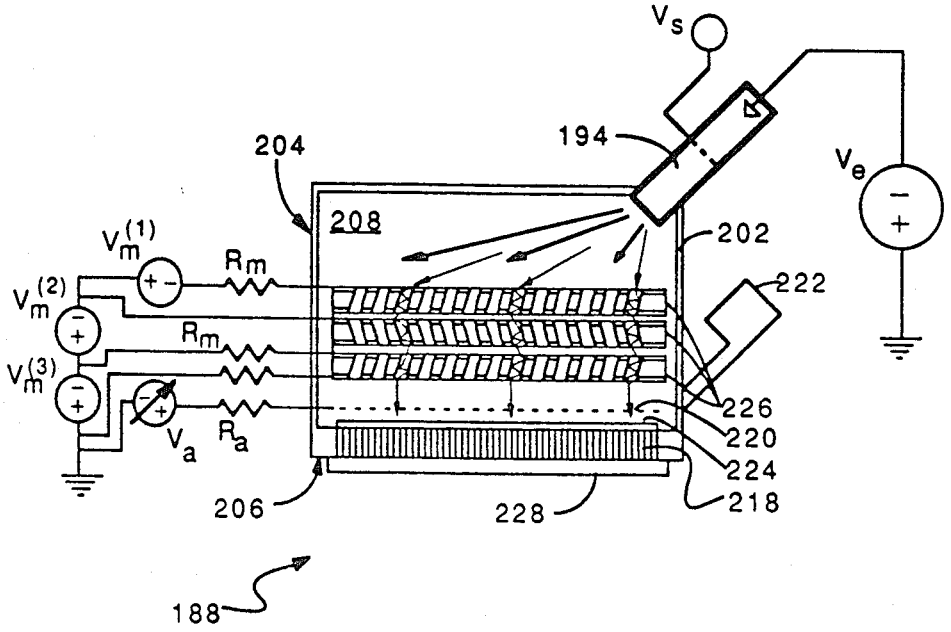
FIG. 11 illustrates in FIGS. 11A, 11B, 11C thereof diagrammatic views illustrating a fourth embodiment of the charge transfer signal processor according to the present invention respectively showing three different input electromagnetic structures.
Figure 11B:
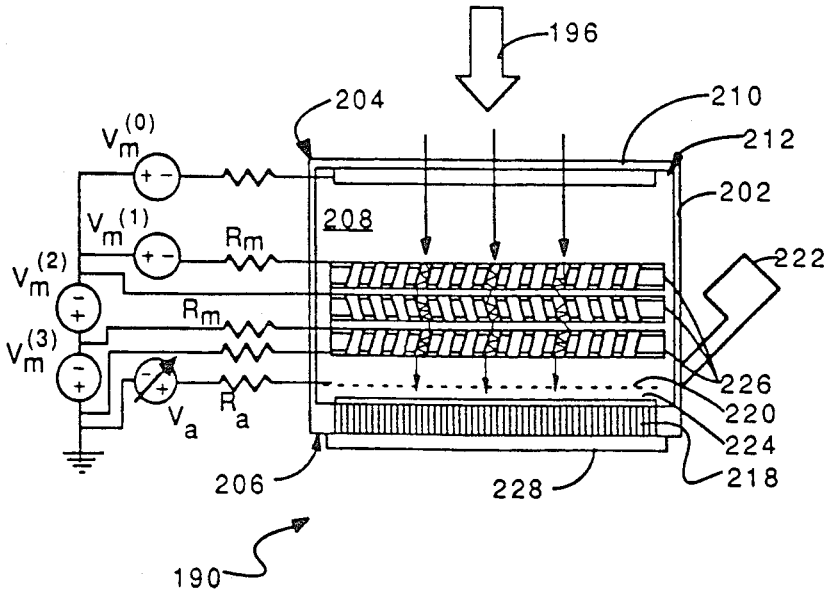
Figure 11C:
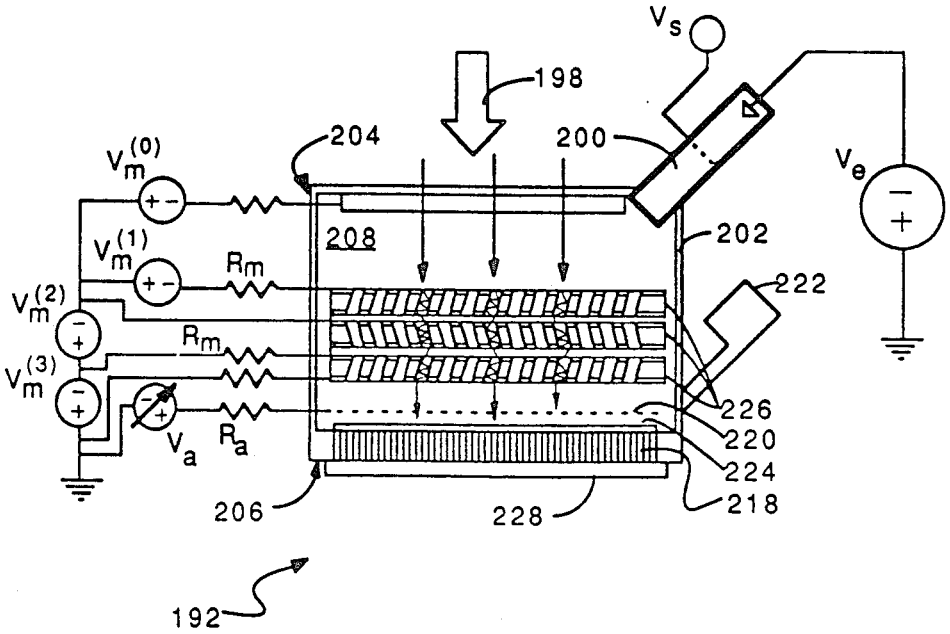

Referring now to FIG. 11, generally designated at 188 in FIG. 11A, at 190 in FIG. 11B, and at 192 in FIG. 11C are high-gain charge transfer signal processors according to the present invention. The charge transfer signal processors 188, 190, 192 are substantially identical to each other, and principally differ in the structure of the input electromagnetic signal excitation source. In FIG. 11A, high-resolution, low-current electron gun 194, in FIG. 11B an input electromagnetic write light source schematically illustrated by an arrow 196, and in FIG. 11C a combination of an input electromagnetic write light source 198 and an electron gun 200 are provided. Each of the high-gain charge transfer signal processors 188, 190, 192 includes a housing 202 having a generally planar top input face generally designated 204 and a generally planar bottom output face generally designated 206 defining an enclosed vacuum 208. The electron gun 194 is vacuum-mounted to the top input face 204 of the high-gain charge transfer signal processor 188 in FIG. 11A, an optically transmissive window 210 having a subjacent deposited photoemissive layer 212 is vacuum-mounted to the face 204 of the high-gain charge transfer signal processor 190 in FIG. 11B, and an optically transmissive window 214 having a subjacent deposited photoemissive layer 216 is vacuum-mounted to the top face 204 of the high-gain charge transfer signal processor 192 of FIG. 11C.

Each of the embodiments 188, 190, 192 includes a charge transfer feedthrough plate subassembly 218 of the type described above that is vacuum-mounted to the bottom face 206 of the housing 202, an acceleration and control grid 220 in the enclosed vacuum 208 and confronting the interior vacuum surface of the charge transfer feedthrough plate subassembly 218, and an optional electron erase source 222 vacuum-mounted to the side of the corresponding housings 202. The gun 222 floods the interior surface of the charge transfer feedthrough plate subassemblies 218 with electrons for erasure of the charge distribution thereon during operation in the framed mode. An electron enhancer coating 224 of the type described above is disposed on the interior planar surface of the charge transfer feedthrough plate subassembly 218 of the several embodiments.

One or more conventional microchannel plate subassemblies 226, three being specifically illustrated, are disposed in the vacuum chamber 208 of the several high-gain charge transfer signal processors 188, 190, 192. The 2-D input electromagnetic signal, as written by the e-beam gun 194 in FIG. 11A and as photoelectrically converted by the photocathode 216 in the embodiments of FIGS. 11B, 11C, is amplified by the one or more microchannel plates 226 by the well-known processor of secondary electron emission therethrough in the several embodiments and in such a way that the 2-D charge distribution cascades through the several microchannel plates and is successively amplified thereby. The acceleration and control grids 220 proximity focuses the amplified 2-D charge distribution produced at the output of the several microchannel plates onto the enhancer coating 224, which charge is then fed through the corresponding electrically-isolated conductors of the corresponding charge transfer feedthrough plate subassemblies and is thereby made available externally of the associated charge transfer signal processors. An output device 228 is provided externally of the bottom face 206 of the housings 202 for utilization of the output, highly-amplified, 2-D electronic charge distribution.

Figure 12:
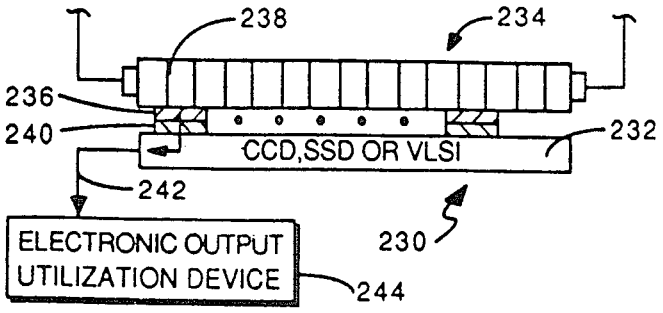
FIGS. 12 through 23 are pictorial diagrams respectively illustrating different output devices of the charge transfer signal processor according to the present invention.

Referring now to FIG. 12, generally designated at 230 is an enlarged schematic view illustrating an output device that is operative to electronically read the 2-D output charge pattern of the charge transfer signal processors of the present invention. An output parallel-to-serial convertor 232, such as a charge coupled device, a switched silicon device, or a very large scale integrated circuit, is mounted to the charge transfer feedthrough plate subassembly generally designated 234 of any of the embodiments of the above-described charge transfer signal processors. Preferably, preselected ones of the electrically-isolated conductors 238 of the feedthrough plate subassembly 234 are bump-bonded as at 236 to one or more corresponding contact pads 240 on the electronic serializer device 232. The serializer 232 is operative in response to the two-dimensional output charge pattern available at the conductors 238 to provide a serial readout thereof as schematically illustrated by an arrow 242. The serial readout may then be input to an electronic or other output utilization device 224.

Figure 13:
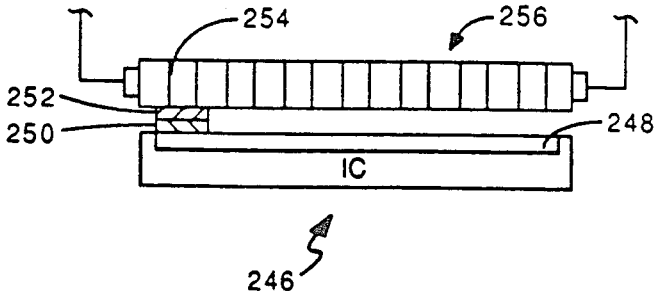

Referring now to FIG. 13, generally designated at 246 is a schematic diagram illustrating an output device that is operative to directly read an input 2-D electromagnetic signal into itself of any of the embodiments of the above-described charge transfer signal processor. An integrated circuit 248 having contact pads 250 is bump-bonded as at 252 to preselected ones of the conductors 254 of the charge transfer feedthrough plate subassembly generally designated at 256. As will readily be appreciated, the charge transfer signal processors of the present invention in this manner are operable as an interface for directly writing the 2-D input electromagnetic signal energy into the integrated circuit or other device such as for high-speed, real-time, 2-D signal processing.

Figure 14:
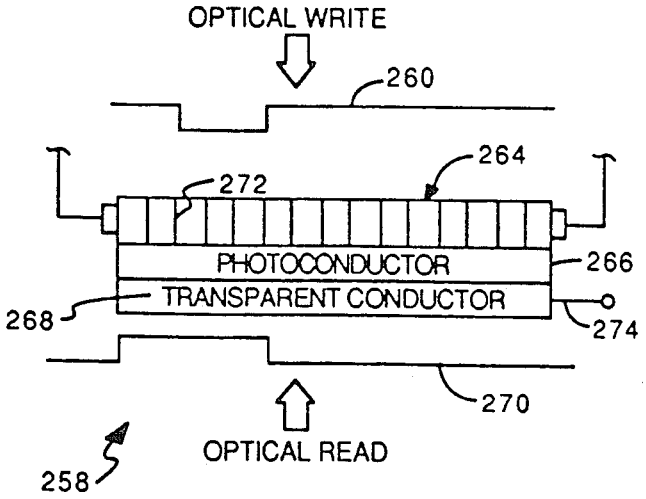

Referring now to FIG. 14, generally designated to 258 is a schematic diagram illustrating an output device that is operative with an optical read control signal for selected positional read-out of the electronic charge distribution on the conductors 272 of the charge transfer feedthrough plate subassembly 264. The intensity of this electronic charge distribution is schematically illustrated by a curve 260. A photoconductor 266, such as silicon is mounted to the external face of the charge transfer feedthrough plate assembly 264. A transparent electrode 268 is mounted to the photoconductor 266. An optical read control signal whose intensity is designated by a curve 270 is applied to selected regions of the exposed transparent conductor 268 and photoconductor 266 on the charge transfer feedthrough plate subassembly 264. As will be appreciated, the illuminated regions of the photoconductor 266 and transparent conductor 268 are conductive so long as the read control signal is present. The charge on the corresponding conductive filaments 272 then passes through the reduced resistance of the illuminated regions of the photoconductor 266 to the transparent conductor 268, from which it is read-out over an output line 274. By controlling the optical read control signal, two-dimensional signal processing of the input 2-D electromagnetic signal is realizable in real-time, such as image centroid detection, correlation, and image detection and analysis.

Figure 15:
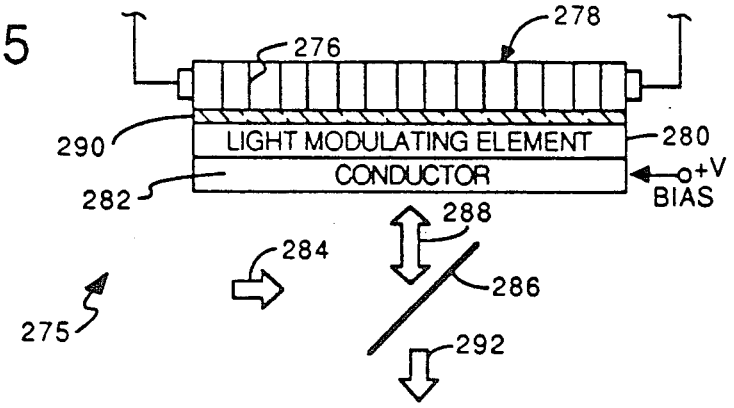

Referring to FIG. 15, generally designated at 275 is a schematic diagram generally illustrating an output device that is operative as a spatial light modulator in any of the several embodiments of the charge transfer signal processor of the present invention. As used herein, the term spatial light modulation designated either spatial phase or spatial amplitude modulation. The electronic charge distribution present on the filaments 276 of the charge transfer feedthrough plate subassembly generally designated 278 produce longitudinally varying electric fields in regions of a light modulating element 280 mounted to the external face of any one of the embodiments of the charge transfer signal processors of the present invention. A transparent electrode 282 is provided over the light modulating element 280. An output 2-D optical readout signal schematically illustrated by an arrow 284 is deviated off a beam splitter 286 and, as is illustrated by a doubleheaded arrow 288, it is deviated thereof onto the light modulating element 280. A mirror 290, which may be provided to either surface of the light modulator element 280, in dependence on the light modulating properties of the light modulating element to be described, reflects it back through the beam splitter 286 as shown by the arrow 288. The phase and/or the amplitude of the 2-D output light as shown by arrow 292 is thereby locally modified, and in proportion with the way that the light modulating element 280 has been locally changed by the electronic charge distribution present on the external face of the charge transfer feedthrough plate subassembly. As will be appreciated, the spatial light modulator is especially useful in applications calling for high-band width, real-time adaptive optics, in applications calling for ultra-high resolution, high-speed, and sensitivity to low-light-levels; and in optical computing applications; among others.

Figure 16:
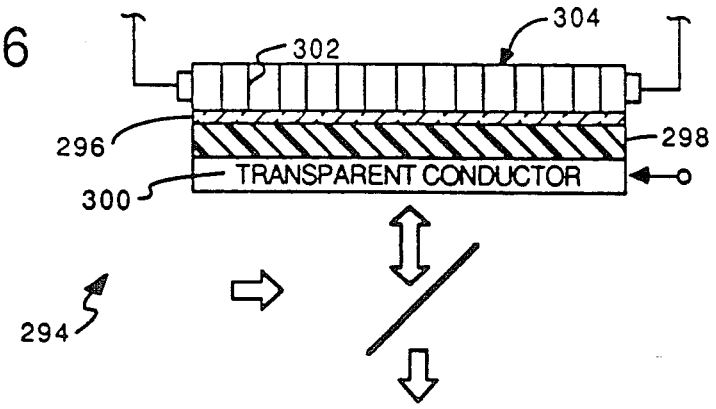

Referring now to FIG. 16, generally designated at 294 is a schematic diagram illustrating one embodiment of a light modulating element useful as a spatial light modulator with any of the embodiments of the charge transfer signal processors of the present invention. It includes an insulative, dielectric mirror 296, and an electro-optic material 298 disposed thereon. The electro-optic material may be, for example, such organic polymers or crystals as MNA, such inorganic crystals as $LiNbO_3$ or KDP, such amorphous structures as poled PLZT and electro-absorptive materials, among others, known to those skilled in the art. A transparent conductor 300 is disposed over the electro-optic material 298. As in the embodiment of FIG. 15, the charge distribution present on the conductors 302 of the charge transfer feedthrough plate subassembly generally designated 304 produces longitudinally varying electric fields through the organic, inorganic, electro-absorptive, and/or amorphous electro-optic materials 298. The effective optical path length and/or the optical absorption of the electro-optic material 298 locally varies in response to the varying field of strength such that the spatial phase and/or amplitude of an output signal deviated off the layer 298 locally varies in accordance with the modulation of the associated region of the layer.

Figure 17:
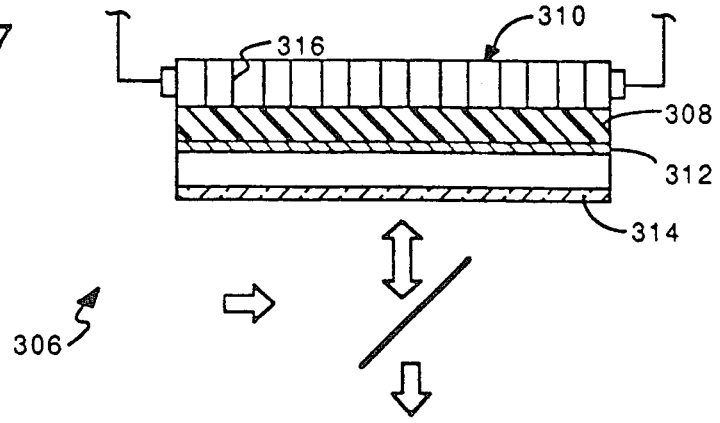

Referring now to FIG. 17, generally designated at 306 is another embodiment of the light modulating element useful as a spatial light modulator according to the present invention. The modulator 306 includes a layer of an elastomer such as a rubber 308 mounted to the exposed face of the charge transfer feedthrough plate subassembly generally designated 310, and a reflective conductor 312 such as indium is provided on the exposed surface of the elastomer 308. A window 314 is provided exteriorly of the deposited reflective conductor 312. The electronic charge variation on the conductors 316 of the charge transfer feedthrough plate subassembly 310 produces longitudinally varying electric fields through the elastomer 308, which locally changes its mechanical dimensions accordingly, so as to provide spatial light modulation of the output light deviated thereof.

Figure 18:
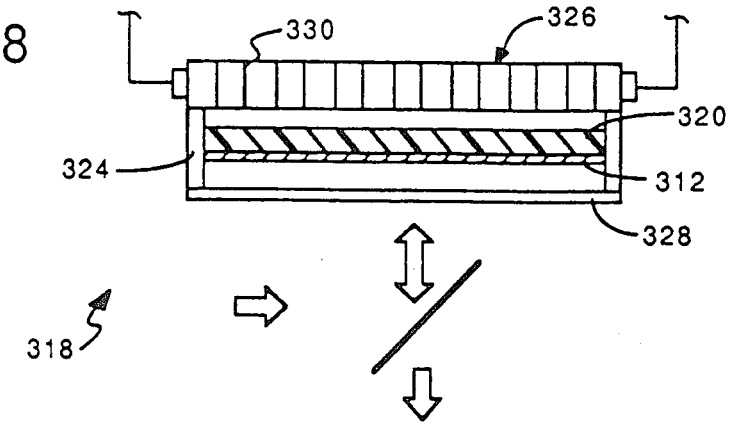

Referring now to FIG. 18, generally designated at 318 is another embodiment of a light modulating element useful for spatial light modulation according to the present invention. The modulator 318 includes as the electro-optic device a membrane 320 such as nitrocellulose having a deposited reflective conductor 322 such as indium that is suspended in a housing 324 and mounted to the exposed face of the charge transfer feedthrough plate subassembly generally designated 326. A window 328 is mounted to the housing 324. The spatially varying electric fields produced by the electronic charge distribution on the conductors 330 of the charge transfer feedthrough plate subassembly 326 locally displace the membrane 320 and therewith the reflective conductor 322 deposited thereon. The different positions of the conductor thereby locally modulate the phase of the output two dimensional light signal deviated thereof.

Figure 19:
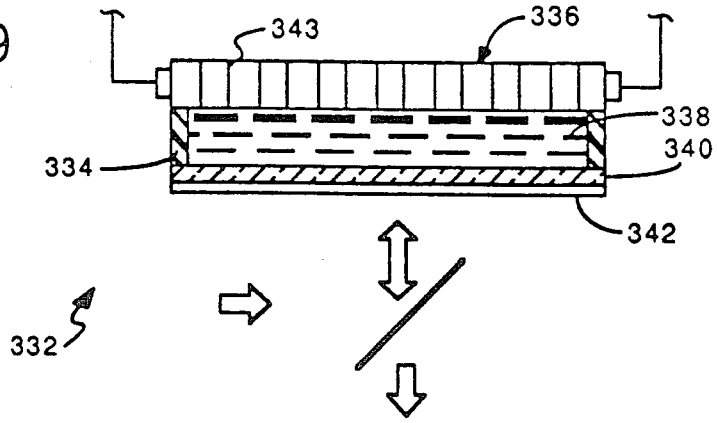

Referring now to FIG. 19, generally designated at 332 is another embodiment of a light modulating element useful for spatial light modulation according to the present invention. A housing 334 is mounted to the exposed face of the charge transfer feedthrough plate subassembly generally designated 336, and a reservoir of electro-optic responsive liquid 338, such as liquid crystals, polar molecules, and electro-absorptive liquids, is provided in the housing 334. A transparent electrode 340 and an optically transparent window 342 are provided at the exposed face of the housing 334. The electronic charge distribution present on the conductors 343 of the charge transfer feedthrough plate subassembly 336 again provide longitudinal electric fields that vary through the liquid material 338, locally changing its optical properties, such that the phase and/or amplitude of an output two dimensional light signal deviated thereof is modulated in accordance with the way the optical properties of the liquid locally change in response to the varying electric field produced by the intensity distribution of the 2-D input electromagnetic signal.

Figure 20:
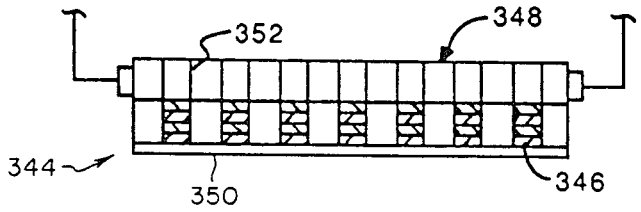

Referring now to FIG. 20, generally designated at 344 is a schematic diagram illustrating another electro-optic element useful as a spatial phase light modulator according to the present invention. The modulator 344 includes discrete stacks of selectably-biased piezoelectric elements 346 mounted to the exposed face of the charge transfer feedthrough plate subassembly generally designated 348, and a reflective conductor 350 disposed across the exposed surface of the stacks of the piezoelectric elements 346. Again, the spatially varying electric fields produced by the electronic charge distribution on the conductors 352 of the charge transfer feedthrough plate subassembly 348 change the mechanical characteristics of the stacks of the piezoelectric elements 346 locally across the two-dimensional output surface of the charge transfer feedthrough subassembly such that the phase of an output 2-D light signal deviated off of the reflective conductor 350 is spatially modulated locally thereby.

Figure 21:
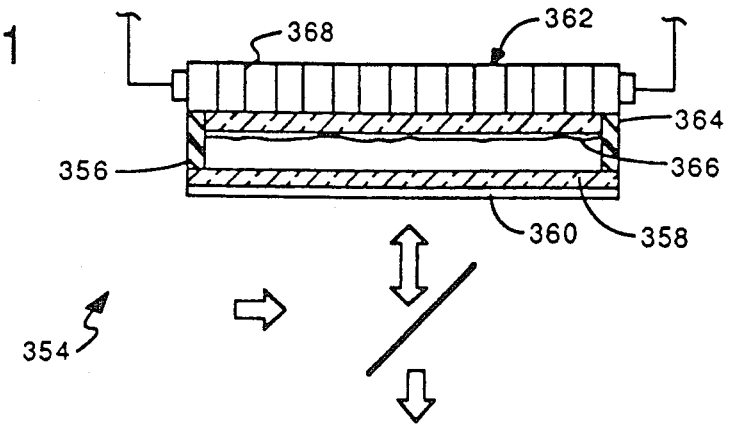

Referring to FIG. 21, generally designated at 354 is a schematic diagram illustrating another embodiment of an electro-optic element useful as a spatial phase light modulator according to the present invention. A housing 356 having a transparent electrode 358 and an outer optically transparent window 360 is mounted to the exposed face of the charge transfer feedthrough plate subassembly generally designated 362. The interior of the housing 356 is maintained at an inert atmosphere, a dielectric mirror 364 is provided therein confronting the exposed external face of the charge transfer feedthrough plate subassembly 362, and a film of a transparent liquid 366, such as an oil, is disposed on the dielectric mirror 364. The thickness of the oil film 366 varies as the electronic charge distribution present on the conductors 368 of the charge transfer feedthrough plate subassembly 362 varies, which again provides 2-D spatial phase light modulation of an output light signal passing through the oil film.

Figure 22:
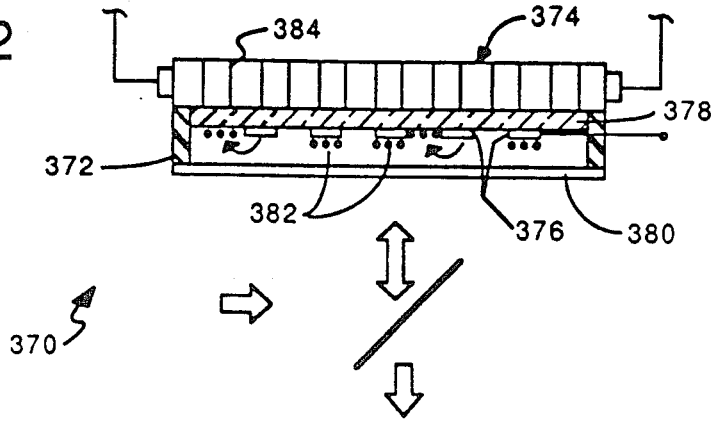

Referring on FIG. 22, generally designated at 370 is a schematic diagram illustrating an electro-optic element useful as a light modulator according to the present invention. A housing 372 is mounted to the exposed face of the charge transfer feedthrough plate subassembly generally designated 374, and an electrically conductive grid 376 is mounted on an insulative mirror 378 and coupled to the charge transfer feedthrough plate subassembly 374. A window 380 is mounted to the housing 372, and a source of opaque toner particles 382 is provided in communication with the inside of the housing 372. In response to the charge pattern present on the electrical conductors 384 of the charge transfer feedthrough plate subassembly 374, the toner particles locally move between the grid 376 and the exposed surface of the dielectric mirror 378. The reflectivity of the mirror 378 locally varies as the toner particle density varies, so that an output light beam reflected off the mirror 378 has its intensity spatially modulated locally to the degree that the toner particles, as determined by the corresponding local electric field strengths, are either present or are absent on corresponding regions of the dielectric mirror.

Figure 23:
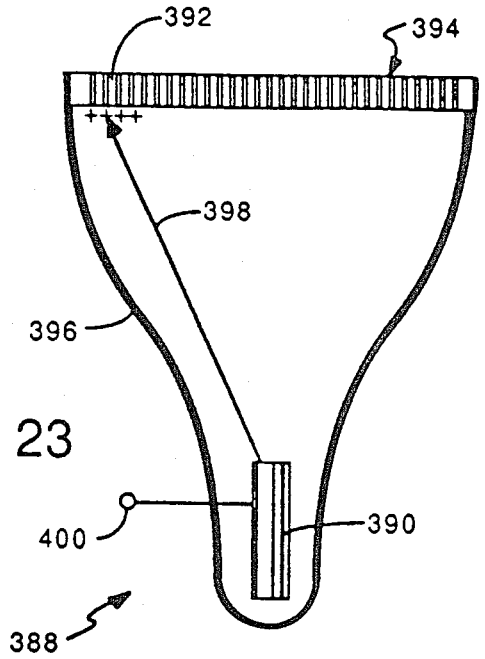

Referring now to FIG. 23, generally designated at 388 is a schematic diagram illustrating another output device for any of the embodiments of the charge transfer signal processor according to the present invention. An electron gun assembly 390 operated in the so-called Vidicon mode is vacuum-mounted to the back face of the housing 396 in position to scan the 2-D array of conductors 392 of the charge transfer feedthrough plate subassembly generally designated 394. The electron gun assembly 390 includes beam deflection components operable in a well-known manner to scan the 2-D array of conductors 392 as schematically illustrated by a ray 398. As will be appreciated, the magnitude of the beam current varies in dependence on the local charge density present on the conductors of the feedthrough plate subassembly. The beam current is monitored as illustrated at 400 to provide a signal indication of the output 2-D electronic charge intensity distribution.

Other electrical, optical, and/or electromechanical output devices, among others, can advantageously be utilized. The foregoing description of the presently preferred output devices is not exhaustive but rather is exemplary of the kind and of the range of the possible technology opened by the present invention. For example, because heat that is generated by the selected output device is readily externally removable, high-power output devices may be selected. Again, because the selected output device is externally mountable to the housings output devices that are not vacuum-compatible may be selected.

Figure 24:
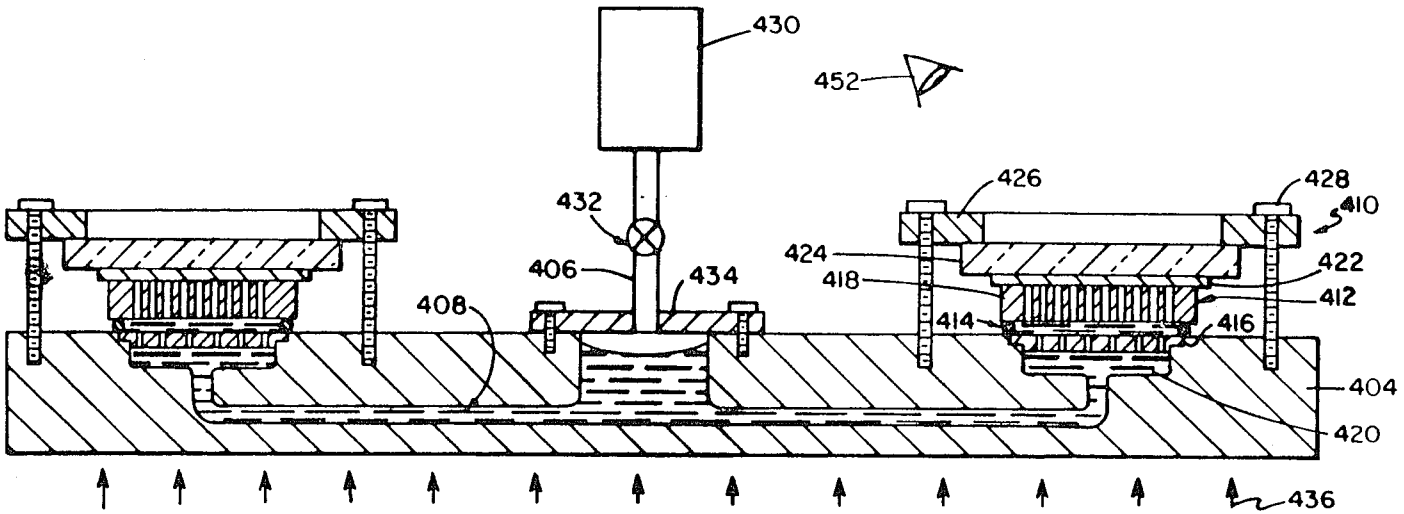
FIG. 24 is a partially pictorial partially schematic diagram illustrating one embodiment of the apparatus for producing high spatial resolution charge transfer feedthrough plates of the present invention.

Referring now to FIG. 24, generally designated at 402 is a partially pictorial and partially schematic diagram illustrating one embodiment of a high spatial resolution charge transfer feedthrough plate production assembly according to the present invention. The production of high spatial resolution charge transfer feedthrough plate assemblies must satisfy certain requirements that are related both to the way in which the assemblies are produced and to the type of assemblies produced. First, the production assembly and method is required to provide substantially parallel conductors in a high spatial resolution array having on the order of a million conductors per square inch, and in such a way that none of the conductors short other conductors in the high spatial resolution array. Furthermore, the conductors themselves must be in a very high precision vacuum-type sealing relation with respect to the insulating matrix within which they are embedded so that they are able to be effectively employed at the output faces of the charge transfer signal processors disclosed herein. Third, the production assembly and method is required to provide such ultra high quality vacuum tight high spatial resolution feedthrough plate assemblies at a comparatively low cost and at comparatively high rate of mass production.

The high spatial resolution charge transfer feedthrough plate production assembly generally designated 402 satisfies these and other requirements, and consists essentially of a liquid metal extruder that receives a porous insulative body, and is operative at a temperature elevated above room temperature to fill each of the plural pores thereof with a conductive flowable metal. Exemplary metals such as indium, tin, zinc, and alloys of indium, tin, and zinc, among others, are contemplated. A glass capillary array is an exemplary porous insulative body. The production apparatus 402 is scalable for use with any size glass capillary array. High spatial resolution charge transfer feedthrough plate assemblies having from 400 conductors per square millimeter to 3,600 conductors per square millimeter are readily produced by the present invention at high volume production levels.

Figure 25:
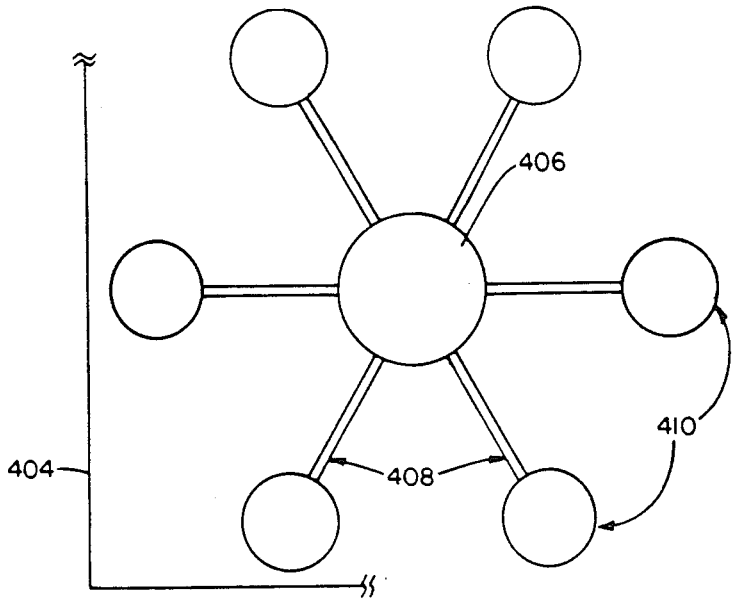
FIG. 25 is a plan diagram illustrating the FIG. 24 embodiment of the feedthrough plate production assembly according to the present invention.

Referring to FIG. 24, the production assembly 402 includes a generally rectangular body 404 of a thermally conductive material such as brass, stainless steel or another metal or other substance. The thermally conductive body 404 includes a central chamber generally designated 406 providing a liquid metal sprue, and one or more liquid metal flow paths in the form of passageways generally designated 408 that are in fluid communication with the liquid metal sprue 406. In the presently preferred embodiment as seen in FIG. 25, six such passageways 408 are provided that are radially extending from the sprue 406 and which are generally symmetrically uniformly spaced about the thermally conductive body 404. The multiple passageways 408 provide multiple liquid metal fluid flow paths to multiple high resolution charge transfer feedthrough plate production stations 410 to be described. A filter, for example, a fine-pore glass capillary array, may be provided within the several passageways to remove sludge and particulate from the liquid metal. The filter is preferably of a porosity smaller than the capillaries being filled. Another number of production stations and flow passageways other than the six specifically illustrated are well within the scope of the invention.

The multiconductor feedthrough plate production stations 410 provided at the ends of the several liquid metal flow paths 408 remote from the central sprue 406 each include a glass capillary array receiving site generally designated 412 operative to hold a glass capillary array to be stuffed with the liquid metal. The liquid metal is extruded into the array in such a way that each and every one of the pores thereby are substantially uniformly filled, so that after the metal is allowed to harden in a manner to be described, the metal-stuffed pores provide substantially short-free vacuum-tight conductors in a high spatial resolution two-dimensional array pattern.

A plenum generally designated 414 is provided in the body 404 confronting the glass capillary array receiving site 412 at each of the stations 410, which is in fluid communication with the associated liquid metal fluid flow passageway 408. A manifold 416, preferably an apertured plate of or coated with a material that the liquid metal does not wet, is provided in communication with the plenum 414 and confronting the glass capillary array receiving site 412. The manifold 416 cooperates with the plenum 414 to distribute the liquid metal delivered into the plenum 414 spatially locally uniformly to the several pores of the glass capillary array received on the receiving site substantially simultaneously, so that all of the pores are totally and uniformly filled. In addition, the manifolds materially facilitate G.C.A. removal after stuffing with the liquid metal and its phase change to the solid state. The several metal "filaments" extending between the G.C.A. and the site are sheared laterally much more readily than if a solid column of metal had to be severed.

A glass capillary array 418 is mounted to the glass capillary array receiving site 412 via a sealing member 420 such as an O-ring that seals the periphery of the interface defined between the glass capillary array and the glass capillary array receiving site. A transparent plate 422 such as a glass slide is disposed loosely on the face of the glass capillary array remote from the site 412. An optical window 424 is disposed on top of the plate 422. A retaining annulus 426 is disposed over the window 424, and fasteners 428 hold the annulus 426 to the body 404.

A source of pressure such as an inert gas tank 430 is coupled to the liquid sprue 406 via a pressure regulator 432 and a gasket 434 fastened to the body 404 at the mouth of the sprue 406. Heat, illustrated by arrows 436, is selectively applied to the body 404 by any suitable means. The gas liquid metal drive source is itself an elastic media, that is self compressible. During injection of liquid metal, the pressure that the G.C.A. "sees" at the receiving site is buffered and softened by the damping action of the self compressing elastic gas, whereby better source control of pressure and improved quality injection are obtained.

Figure 26:
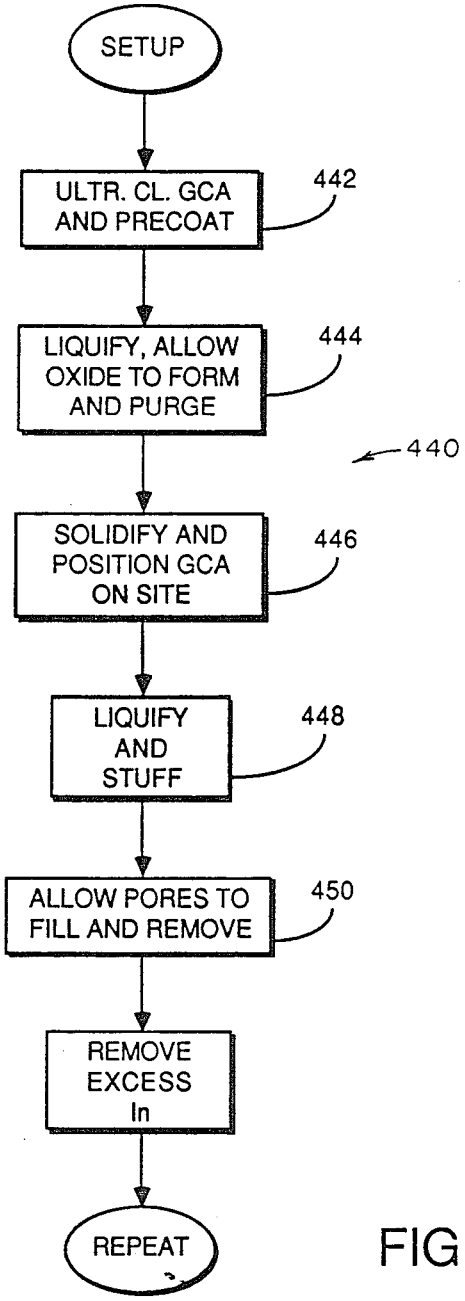
FIG. 26 is a flow chart useful in illustrating the method of producing high spatial resolution charge transfer feedthrough plate assemblies according to the present invention.

Referring now to FIG. 26, generally designated at 440 is a flow chart illustrating the operation of the FIGS. 24, 25 embodiment of the high spatial resolution charge transfer feedthrough plate production assembly of the present invention. As shown by a block 442, the glass capillary arrays to be stuffed with liquid metal are first cleaned to allow the selected liquid metal to wet the glass surface of the arrays. Preferably, the arrays are cleaned by immersion in an ultrasonic bath using solvents (e.g. acetone). After cleaning, the arrays are coated with a thin layer of the material with which they are to be stuffed, as by flash evaporation of a very thin Indium layer. The precoating reduces the surface tension during injection of the liquid metal and therewith reduces the pressure necessary to effect filling the array. In all embodiments herein, the precoating with a layer of the metal to be injected is contemplated.

As shown by a block 444, the body 404 is heated to a temperature that is a few degrees above the melting point of the selected metal so that it changes to its liquid state. The heat initiates an oxidation of the manifold and of the receiving site, providing a surface layer that the liquid metal does not wet. In the liquid state, the pressure provided by gas tank 430 acts on and moves the liquid metal through the flow passageways 408. The flowing metal purges the passageways of any air therein. In the plenum 414, of each of the stations 410, the oxide layer thereabout substantially eliminates sticking between the metal and the injection stations.

As shown by a block 446, heat to a temperature a few degrees below the melting temperature of the indium is then applied to the body 404 so that the liquid metal changes into its solid state. While the metal is in the solid phase, the glass capillary array 418 is positioned into sealing relation with the glass capillary array receiving site at each of the stations 410, and removably fastened thereonto, by the fasteners 428.

As shown by a block 448, the applied heat is thereafter increased, and the indium assumes its liquid phase. The pressure of the gas tank 430 causes the liquid metal to flow through the several liquid metal fluid flow passageways 408, and into the respective plenums, of the several stations 410. As the metal is delivered to and fills the respective plenums at the glass capillary array receiving sites of the associated production stations, the liquid metal is distributed by the manifolds 416 spatially to every pore of the glass capillary arrays substantially simultaneously. The liquid metal flows upwardly into the several pores and is stopped by the abutting glass slide, substantially completely filling each and every one of them. An observer schematically illustrated at 452 in FIG. 24, visually determines, by observing through the optical window and the glass slide with aid of a suitable optical instrument (e.g. microscope) that the pore filling operation is complete. As shown by a block 450, the liquid metal stuffed glass capillary arrays are then removed from their corresponding stations 410, any excess indium is removed therefrom, and the process is repeated on another batch of glass capillary arrays.

Figure 27:
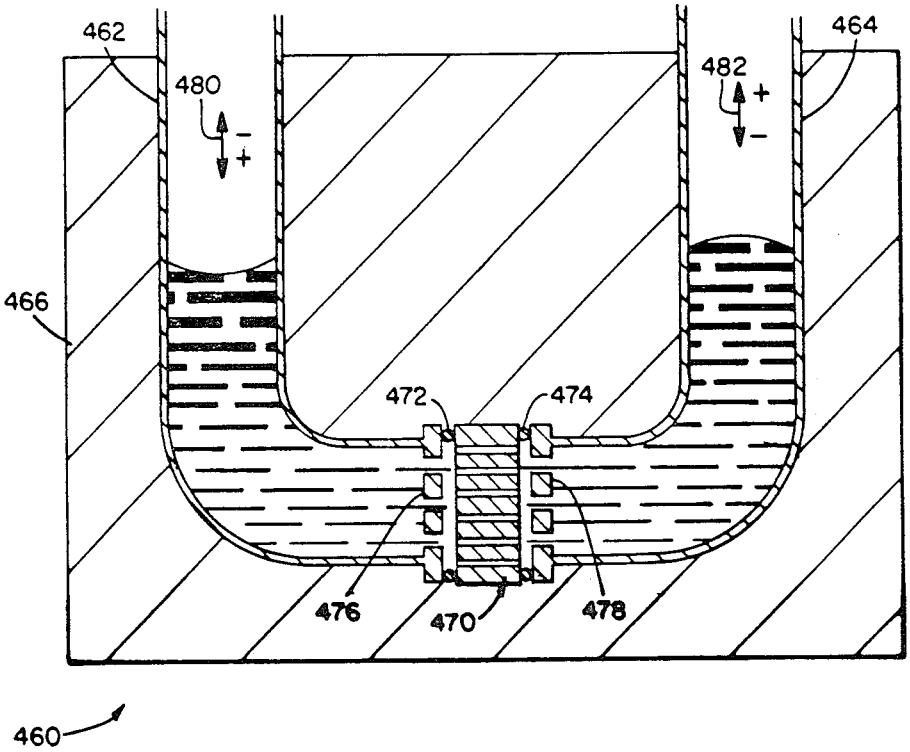
FIG. 27 is a partially pictorial partially schematic diagram illustrating another embodiment of the high spatial resolution charge transfer feedthrough plate production assembly according to the present invention.

Referring now to FIG. 27, generally shown at 460 is a partially schematic partially pictorial diagram illustrating another embodiment of the high spatial resolution charge transfer feedthrough plate production assembly according to the present invention. First and second liquid metal fluid flow passageways 462, 464 are provided in a heated body 466, such as an oven, respectively to each side of a glass capillary array generally designated 470. O-rings 472, 474 are provided intermediate the passageways 462, 464 and the confronting surface of the glass capillary array 470 for peripherally sealing the interfaces defined therebetween. Manifolds 476, 478, preferably porous plates of or coated with a material that the liquid metal does not wet, are provided in the passages 462, 464 for distributing the liquid metal flow spatially to every pore of the glass capillary array captured therebetween. As in the embodiment of FIGS. 24 and 25, the manifold furthermore substantially facilitates G.C.A. removal since the "filaments" are more readily shearable laterally than a solid column of hardened metal.

The high spatial resolution charge transfer feedthrough plate production assembly 460 is operative to completely prevent air entrapment in any of the several liquid metal filled capillary pores of the glass capillary arrays. As shown schematically by arrows 480, 482 that have bi-directional heads marked "+, −", the liquid metal, such as indium, that is in the passageways 462, 464, is caused to move through the several pores of the glass capillary array first in one direction, then in the reverse direction, selectably, in single or multiple cycles. The positive and negative pressures may suitably be provided by pressurized tanks or vacuum apparatus well known to those skilled in the art. The positive pressures preferably are generated by a gas source, which gas source, being self-compressible as already mentioned, helps to control the pressure and improves injection quality.

The reciprocal liquid metal movement, first in one direction, then in the other direction through the glass capillary array, has been found to provide complete filling of each of the capillary pores of the glass capillary array such that no air bubbles are entrapped therein. After the intended number of one or more cycles, the temperature of the oven is set a few degrees below the liquid metal melting temperature, and the glass capillary array stuffed with the liquid metal is removed from the receiving site. Another glass capillary array to be stuffed is positioned in the site, and this process is repeated. As is the case with the above embodiment, the surfaces of the GCA receiving site and both the manifolds surfaces are severally coated with an oxide or other barrier, so that thereby sticking is precluded at the corresponding interfaces.

Figure 28:
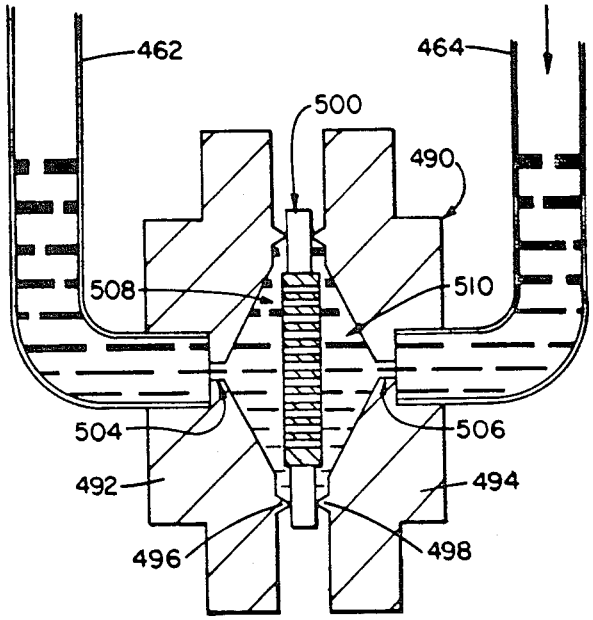
FIG. 28 is a fragmentary, partially pictorial, partially schematic diagram illustrating a modification of the FIG. 27 embodiment of the high spatial resolution charge transfer feedthrough plate production assembly according to the present invention.

Referring now to FIG. 28, generally designated at 490 is an alternate embodiment of a mechanism for receiving a glass capillary array in the bi-directional high-spatial resolution charge transfer feedthrough plate production assembly of FIG. 27. The liquid metal fluid flow passageways 462, 464 are terminated in apertures provided therefor in first and second mating glass capillary array support headers 492, 494. Each of the headers 492, 494 includes confronting, annular knife-edged flanges 496, 498 that capture a glass capillary array support ring 500 therebetween in sealing relation. A glass capillary array 502 is slidably inserted into and removably held in the support ring 500. Flow restricting gates generally designated 504, 506 are provided at the mouths of the passageways 462, 464 that terminate in conical plenums generally designated 508, 510. The plenums 508, 510 receive the liquid metal and distribute it locally to every pore of the G.C.A. After hardening, the metal is readily released by imparting a torque, which breaks the G.C.A. loose from the walls of the plenums.

The members 492, 494 are preferably fabricated of a material that is not wet by the liquid metal such as stainless steel for indium. Any suitable means for releasably holding the members 492, 494 together, such as clamps, not shown, may be employed. After one or more cycles of flow of the liquid metal through the glass capillary array in the reciprocal flow directions, the pores thereof are completely filled without trapped air. The oven heat is again lowered to solidify the liquid metal, and the fixture is opened releasing the stuffed array. Any plug at the gates 504, 506 is broken, excess indium is removed from the charge transfer feedthrough plate production assembly, and the process is repeated with another glass capillary array.

Figure 29:
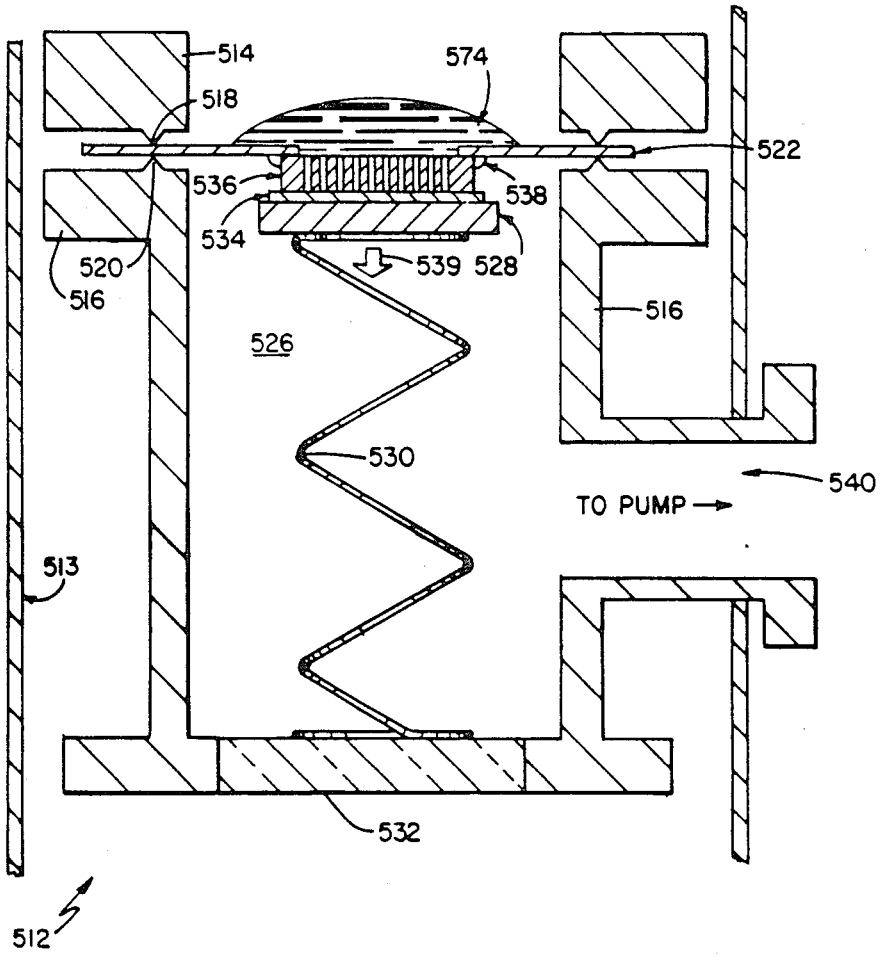
FIG. 29 is a partially pictorial partially schematic diagram illustrating a further embodiment of the high spatial resolution charge transfer feedthrough plate production assembly according to the present invention.

Referring now to FIG. 29, generally designated at 512 is another embodiment of the high spatial resolution charge transfer feedthrough plate production assembly according to the present invention. The assembly 512 includes a heatable body 513, such as an oven. Top and bottom stainless-steel members 514, 516 having knife edges 518, 520 are cooperative to removably retain and capture therebetween an annulus 522 in vacuum-tight sealing relation. Liquid metal 524 is disposed on the annulus 522.

The walls 516 define a chamber generally designated 526 subjacent the ring 522. A glass or another support block 528 defining a glass capillary array receiving site is mounted by a coil spring 530 to an optical window 532 mounted at the base of the production assembly 512. A very thin glass slide 534 is disposed on top of the support glass block 528, and a glass capillary array 536 is mounted on top of the thin glass slide 534. A high temperature epoxy 538 is provided around the peripheral interface of the glass capillary array and the O-ring 522.

Liquid metal is caused to flow along a liquid metal flow path illustrated by an arrow 539 downwardly and into the pores of the glass capillary array 536 by the action of an adjustable negative pressure produced in the chamber 526 via a port connected to a vacuum pump. An observer watching through the window 532 with the aid of an instrument such as a microscope determines that and when the filling process is completed, and thereafter, the heat is lowered and the vacuum is turned off. The flange assembly 514, 516 is disassembled after the liquid metal assumes its solid phase, whereafter the stuffed high spatial resolution glass capillary array is removed. Another array is placed thereon, and the same process is repeated.

Figure 30:
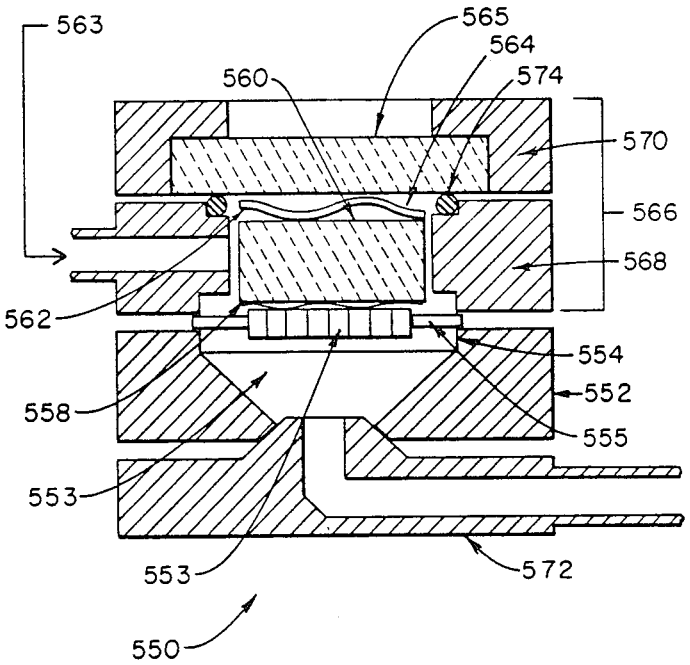
FIG. 30 is a partially pictorial, partially schematic diagram illustrating yet another embodiment of the high spatial resolution charge transfer feedthrough plate production assembly according to the present invention.

Referring now to FIG. 30, generally designated at 550 is another embodiment in accordance with the feedthrough plate production assembly and method of the instant invention. The station 550 includes a header 552 mounted by bolts or other clamps at and to the mouth of a liquid metal fluid flow passageway 572 to receive on sealing knife edges 554 thereof a G.C.A. 553 that is bonded by a friting, epoxy, or otherwise to a metallic retaining annulus 555. After fabrication of the multichannel feedthrough plate assembly, the annulus, like in the FIG. 28 embodiment, forms an integral part of the fabricated feedthrough plate assembly. The header 552 receives the liquid metal delivered thereto in a conical plenum generally designated 556, which acts as a spatial distribution manifold as well as provides a G.C.A. quick-release geometry after impregnation.

A transparent slide 558 is supported on the top of the G.C.A., and an optical flat 560 of a preselected thickness selected so as to retain its integrity during operation is supported on top of the glass slide 558. A wave washer or other tension spring 562 in a cavity generally designated 564 of complimentary header 566 positioned intermediate an optical window 565 of the header 566 and the flat 560 produces a pressure that keeps the glass slide 558 in intimate contact with the G.C.A. 553 when the two headers are clamped together to make a leak-tight seal at the knife edge. A vacuum pump, not shown, is connected to the cavity 564 via passageway generally designated 563. The header 566 includes upper and lower members 568, 570 and an intermediate seal 574 such as an O-ring. Any suitable clamp may be provided to releasably hold the members 568, 570 together. It is important that the header assemblies and the passageway terminating cone be made of a material that the liquid metal does not wet.

In operation, a precoated G.C.A. is inserted into the annulus, which is mounted between the knife edges of and retained by the headers. The station 550 is usable with different liquid metals having a wide range of melting points.

The selected liquid metal is caused to move into the plenum 556 primarily by the positive buffered pressure of a gas liquid metal drive source via liquid metal fluid flow passageway 572, and secondarily by the negative pressure induced by the vacuum source. The pressure on the flat 560 due to the tension of the spring 562 opposes the positive gas pressure and the negative vacuum pressure, so that the force at the G.C.A. is the differential thereof. The spring force and weight are selected to balance the positive and negative pressures, whereby the differential is zero and higher absolute gas pressures may be applied by the positive gas drive source before the G.C.A. experiences an overstress condition.

The liquid metal delivered to the plenum is distributed thereby to and into the several pores of the G.C.A. An observer views the process via the window, and after the pores are injected with liquid metal and it is allowed to harden, the header 566 of the station 550 is readily disassembled, the G.C.A. is released from the plenum by a torque action, and the process is repeated.

It will be appreciated that many modifications of the presently disclosed invention will become apparent to those skilled in the art without departing from the inventive concept.

What is claimed is:

1. A high spatial resolution charge transfer feedthrough plate production assembly utilizing a liquid metal material, comprising:

reservoir means for holding a quantity of the liquid metal material in the liquid state sufficient to fill many glass capillary arrays;

means for providing a liquid metal fluid flow path in communication with the liquid metal material held in said reservoir means;

means for providing gas pressure to cause the liquid metal material in said liquid metal fluid flow path to flow along said liquid metal flow path;

means for providing a site in communication with said liquid metal fluid flow path for receiving a glass capillary array;

means coupled to said site and cooperative with said liquid metal fluid flow path for sealing the peripheral interface defined between the glass capillary array in the received condition at said site and confronting surfaces of said site in such a way that the liquid metal material delivered to said site by said liquid metal fluid flow path is caused to flow into pores of the glass capillary array received on said site; and means coupled to said liquid metal fluid flow path and to said site and responsive to the liquid metal material delivered to said site for distributing the liquid metal material spatially locally into every pore of the received glass capillary array substantially simultaneously to provide substantially uniform filling of the pores thereof and for providing quick and easy release of the glass capillary array from said site after all of the pores of the glass capillary array have been filled.

2. The production assembly of claim 1, wherein said gas pressure providing means includes a positive pressure source.

3. The production assembly of claim 1, wherein said gas pressure providing means includes a negative pressure source.

4. The production assembly of claim 1, wherein said gas pressure providing means is operative to cyclically cause the liquid metal material to flow first in one direction and then in the reciprocal direction through said site.

5. The production assembly of claim 1, wherein said gas pressure means is operative to cause the liquid metal material to flow unidirectionally through said site.

6. The production assembly of claim 1, wherein said liquid metal fluid flow path terminates in a mouth, and wherein said site providing means includes a surface defined at said mouth of said liquid metal fluid flow path.

7. The production assembly of claim 1, wherein said site providing means is located within and along said liquid metal fluid flow path.

8. The production assembly of claim 1, wherein said sealing means includes an O-ring.

9. The production assembly of claim 1, wherein said sealing means includes liquid metal non-wettable plates and complementary cooperative flanges disposed on said liquid metal non-wettable plates.

10. A method for producing high spatial resolution charge transfer feedthrough plates utilizing a liquid metal material, comprising the steps of:

coating a glass capillary array to be impregnated by the liquid metal material with a film of the metal to reduce the pressure needed to impregnate the glass capillary array with the liquid metal material;

supporting the coated glass capillary array at a glass capillary array receiving site in such a way that pores of the coated glass capillary array are able to be impregnated with the liquid metal material;

moving the liquid metal material along a liquid metal fluid flow path selected to impregnate the pores of the glass capillary array substantially uniformly along each of their lengths without any entrapped air or other defilements;

moving the flow of the liquid metal material along the reciprocal flow path through the glass capillary array to move the liquid metal material back through the pores of the glass capillary array in the reciprocal direction to further ensure that no air or other defilements are entrapped in any of the pores of the glass capillary array; and changing the state of the liquid metal material stuffed in the pores of the glass capillary array into the solid phase, whereby vacuum-tight, high spatial resolution charge transfer feedthrough plate assemblies are produced.

11. The method of claim 10, wherein said moving steps are accomplished by a positive pressure produced by a gas source.

12. The method of claim 10, wherein said moving step are accomplished by a negative pressure.

13. The method of claim 10, wherein said reciprocal moving step is accomplished by the alternative application of positive and negative pressures.

14. A high spatial resolution charge transfer feedthrough plate production assembly utilizing a liquid metal material, comprising:

means for providing a liquid metal fluid flow path in communication with the liquid metal material;

self-compressible gas means for providing gas pressure to cause the liquid metal material in said liquid metal fluid flow path to flow along said liquid metal fluid flow path in response to a first gas pressure imparted thereto by said self-compressible gas means;

means for providing a site in communication with said liquid metal fluid flow path for receiving a glass capillary array;

means coupled to said site and cooperative with said liquid metal fluid flow path for sealing the peripheral interface defined between the glass capillary array in the received condition at said site and confronting surfaces of said site in such a way that the liquid metal material delivered to said site by said liquid metal fluid flow path is caused to flow into pores of the glass capillary array received on said site by actions of the first pressure imparted to the liquid metal material by said self-compressible gas means; and means coupled to said site for providing a second pressure opposite to and partially cancelling the first pressure so that it is a differential pressure that the glass capillary array "sees" at said site permitting higher absolute pressures.

15. The production assembly of claim 14, further including means coupled to said liquid metal fluid flow path and to said site and responsive to the liquid metal material delivered to said site for distributing the liquid metal material apatially locally into every pore of the received glass capillary array substantially simultaneously to provide substantially uniform filling of the pores thereof and for providing quick and easy release of the glass capillary array from said site after all of the pores of the glass capillary array have been filled.

16. The production assembly of claim 14, further including means coupled to said site providing means for viewing the glass capillary array so that the quality of the filling of the pores thereof can be optically determined in real-time.

17. The production assembly of claim 14, wherein said self-compressible gas means includes a gas source driving a reservoir of the liquid metal material connected to a flow passageway so that as the pressure changes the gas self-compresses providing a more uniform pressure characteristic and improved quality liquid metal material delivery.

18. The production assembly of claim 17, wherein said opposite pressure means includes means for actively supplying a counter pressure.

19. The production assembly of claim 18, wherein said activity supplying means includes a tension spring mounted to the received glass capillary array for urging it in a direction opposed to the direction it is urged by action of contacting the moving liquid metal material.

20. The production assembly of claim 18, wherein said opposite pressure means includes means for passively supplying a counter pressure.

21. The production assembly of claim 20, wherein said passively supplying means includes a transparent weight in the form of an optical flat.

* * * * *

UNITED STATES PATENT AND TRADEMARK OFFICE

CERTIFICATE OF CORRECTION

PATENT NO. : 4,863,759

DATED : September 5, 1989

INVENTOR(S) : Cardinal Warde, Robert F. Dillon & Brian A. Hill

It is certified that error appears in the above-identified patent and that said Letters Patent is hereby corrected as shown below:

Column 6, line 1, "temporal and width" should read --temporal bandwidth--.

Column 8, line 2-3, "other O suitable" should read --other suitable

Column 9, line 62, "so that is often" should read --so that it is often--.

Column 11, line 47, "$V_v(2)$" should read --$V_m(2)$--.

Column 13, line 51, "photocathode 216 in" should read --photocathode 212, 216 in--.

Column 13, line 53-54, "processor of secondary" should read --process of secondary--.

Column 14, line 68, "designated either spatial" should read --designates either spatial--.

Column 15, line 12, "doubleheaded arrow" should read --double-headed arrow--.

UNITED STATES PATENT AND TRADEMARK OFFICE

CERTIFICATE OF CORRECTION

PATENT NO. : 4,863,759

DATED : September 5, 1989

INVENTOR(S) : Cardinal Warde, et al

It is certified that error appears in the above-identified patent and that said Letters Patent is hereby corrected as shown below:

Column 25, line 20, "by actions of the" should read --by action of the--.

Column 25, line 32, "material apatially" should read --material spatially--.

Signed and Sealed this

Fifteenth Day of September, 1992

*Attest:*

DOUGLAS B. COMER

*Attesting Officer*

*Acting Commissioner of Patents and Trademarks*